US006008582A

United States Patent [19]

Asano et al.

[11] Patent Number: 6,008,582

[45] Date of Patent: Dec. 28, 1999

[54] PLASMA DISPLAY DEVICE WITH AUXILIARY PARTITION WALLS, CORRUGATED, TIERED AND PIGMENTED WALLS

[75] Inventors: Masaaki Asano; Yoshiaki Tsuruoka; Hisao Tanabe, all of Tokyo-To, Japan

[73] Assignee: Dai Nippon Printing Co., Ltd., Tokyo, Japan

[21] Appl. No.: 09/012,087

[22] Filed: Jan. 22, 1998

[30] Foreign Application Priority Data

| | | | |
|---|---|---|---|
| Jan. 27, 1997 | [JP] | Japan | 9-012546 |
| May 20, 1997 | [JP] | Japan | 9-144573 |
| May 20, 1997 | [JP] | Japan | 9-144574 |
| May 23, 1997 | [JP] | Japan | 9-148428 |

[51] Int. Cl.[6] ..... H01J 17/49

[52] U.S. Cl. ..... 313/582; 313/584; 313/609; 313/632

[58] Field of Search ..... 313/581, 590, 313/605, 606, 609, 610, 620, 492, 584, 585, 586, 587, 612, 621

[56] References Cited

U.S. PATENT DOCUMENTS

| | | | |
|---|---|---|---|
| 3,704,052 | 11/1972 | Coleman | 316/17 |
| 4,996,460 | 2/1991 | Kim et al. | 313/586 |
| 5,032,768 | 7/1991 | Lee et al. | 313/582 |
| 5,086,297 | 2/1992 | Kiyake et al. | 340/759 |
| 5,138,225 | 8/1992 | Kim | 313/584 |
| 5,144,200 | 9/1992 | Kim | 313/584 |
| 5,541,479 | 7/1996 | Nagakubo | 313/586 |

*Primary Examiner*—Vip Patel
*Assistant Examiner*—Matthew Gerike
*Attorney, Agent, or Firm*—Morgan & Finnegan LLP

[57] ABSTRACT

A plasma display panel has a front plate (10) and a back plate (3) disposed in parallel and opposite to each other, and spaced a predetermined distance apart from each other by partition walls (1*a*, 1*b*, 1*c*). The partition walls (1*a*, 1*b*, 1*c*) define discharge spaces (2) each having a plurality of discharge cells. Phosphor layers (9) are formed on surfaces of the discharge spaces (2). The partition walls (1*a*, 1*b*, 1*c*) is formed of a material containing at least one of red, green and blue pigments. Since the partition walls (1*a*, 1*b*, 1*c*) are capable of luminance adjustment and white balance adjustment, the plasma display panel does not need any additional manufacturing processes and can be fabricated at a relatively low cost.

16 Claims, 10 Drawing Sheets

PLASMA DISPLAY DEVICE WITH AUXILIARY PARTITION WALLS, CORRUGATED, TIERED AND PIGMENTED WALLS

BACKGROUND OF THE INVENTION

The present invention relates to a color plasma display panel (hereinafter abbreviated to "PDP"), i.e., a flat display of a spontaneous emission system using gas-discharge.

DESCRIPTION OF THE RELATED ART

Generally, a PDP is constructed by forming arrays of electrodes on two glass plates disposed opposite to each other with a discharge space between the glass plates to form a plurality of sets of electrodes, forming a phosphor layer on the inner surface of one of the two glass plates, and sealing a gas containing Ne or Xe as a principal component in the discharge space between the two glass plates. A voltage is applied across each set of electrodes to produce a discharge in a minute cell around the set of electrodes to make a portion of the phosphor layer corresponding to the cell emit light. When displaying information, the regularly arranged cells are energized selectively to produce light by a gas discharge. PDPs are classified into dc PDPs having electrodes exposed to the discharge space and ac PDPs having electrodes covered with an insulating layer. PDPs are classified also by function and driving method into those of a refresh drive system and those of a memory drive system.

Three color phosphor layers respectively containing three color phosphor substances are used for color display. Since the color phosphor substances emit light in different luminances, respectively, the color phosphor substance contents of the three color phosphor layers are adjusted properly so that the three color phosphor layers have the same luminance or white balance is adjusted by placing color filters on the front surface of a screen. The former method changes the extent of the discharge space and hence discharge margin cannot be secured. The latter method needs additional members and additional processes, which increases the cost.

SUMMARY OF THE INVENTION

Accordingly, it is an object of the present invention to provide a plasma display panel capable of adjusting the respective luminances of phosphor layers energized in a discharge space and white balance between the phosphor layers, and of increasing the luminances of the phosphor layers.

According to a first aspect of the present invention, a plasma display panel comprises a front plate, a back plate disposed in parallel and opposite to the front plate, a plurality of parallel partition walls (barrier ribs) disposed between the front and the back plate so as to form discharge spaces between the front and the back plate, and phosphor layers formed respectively in the discharge spaces. The phosphor layers contain a red phosphor substance, a green phosphor substance and a blue phosphor substance, respectively, and the partition walls contain at least one of red, green and blue pigments.

The plasma display panel can be fabricated by a reduced number of processes because the partition walls has a function to adjust the luminances of red, green and blue colors or a function to adjust white balance.

The partition walls of the plasma display panel of the present invention include the partition walls formed on the inner surface of the back plate in parallel to address electrodes, and auxiliary partition walls formed on the inner surface of the back plate in parallel to bus electrodes so as to isolate discharge spaces demarcated by the address electrodes and the buss electrodes from each other.

Since each discharge space is demarcated on its four sides by the partition walls and the auxiliary walls, the surfaces of the auxiliary walls increase the light emitting area of the phosphor layer. Consequently, ultraviolet rays (hereinafter referred to as "UV rays") act efficiently on the phosphor surface, whereby the luminance of the phosphor surface is increased. The auxiliary partition wall prevents discharge in the discharge spaces adjacent thereto with respect to a direction in which the address electrodes are extended or the leakage of UV rays produced by discharge.

According to the present invention, the two edges of a section of the auxiliary partition wall in a plane parallel to the address electrodes may diverge toward the back plate.

According to the present invention, the ratio of the quantity of light rays emitted by the phosphor layer formed on the auxiliary partition wall and traveling toward the front plate to the quantity of those emitted by the phosphor layer is increased, whereby apparent luminance is further enhanced. The area of the auxiliary partition walls on the back plate is large, the auxiliary partition walls and the partition walls are strong. Therefore, the partition wall and the auxiliary partition walls may be formed in a relatively small width and the discharge spaces can be formed in a large volume, which further enhances discharge efficiency. Since pixels can be arranged at small pitches, the plasma display panel is capable of displaying pictures in a high definition.

According to the present invention, the height of the auxiliary partition walls may be lower than that of the partition walls and may be in the range of ½ to ⅚ of that of the partition walls. The auxiliary partition walls having a height in such a range are capable of exercising a function similar to the foregoing function. The phosphor layers can be easily formed because the auxiliary partition walls are lower than the partition walls.

According to the present invention, a portion of each of the plurality of parallel partition walls formed on the back plate may be formed in a reduced width to enlarge the corresponding discharge space.

According to the present invention, the luminance can be increased because a portion of each of the plurality of parallel partition walls are formed in a reduced width to enlarge the corresponding discharge space in order that UV rays are produced efficiently, the light emitting area of the phosphor layers is increased, and the UV rays act efficiently on the phosphor layers. On the other hand, portions of the partition walls other than those corresponding to the discharge cells are formed in a relatively great width necessary for the partition walls function properly.

According to the present invention, the side surfaces of the plurality of parallel partition walls may formed in wavy surfaces so that the side surfaces of the partition walls have a relatively large area.

According to the present invention, the plasma display panel can display pictures in a high luminance because the wavy side surfaces of the partition walls have a relatively large area, the light emitting area of the phosphor layers is relatively large and UV rays act efficiently on the phosphor layers.

According to the present invention, the width of the plurality of parallel partition walls formed on the back plate may be decreased stepwise from the base toward the top.

When the width of the partition walls is thus decreased stepwise from the base toward the top, the phosphor layers can be formed in a relatively large area and the luminance can be increased because the UV rays act efficiently on the phosphor layers.

In the plasma display panel of the present invention in which the front plate and the back plate of glass are disposed in parallel and opposite to each other and are spaced a predetermined distance apart by the partition walls formed on the back plate, a gap may be formed between each of the partition walls and the front plate. The gap enhances the efficiency of discharge and thereby the luminance is enhanced. The gap may be in the range of 3 to 20 $\mu$m, which is suitable for securing a margin for operation.

According to the present invention, recesses may be formed in the inner surface of the front plate to define the gaps.

According to the present invention, protrusions may be used for forming the gaps.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

Figure 1:
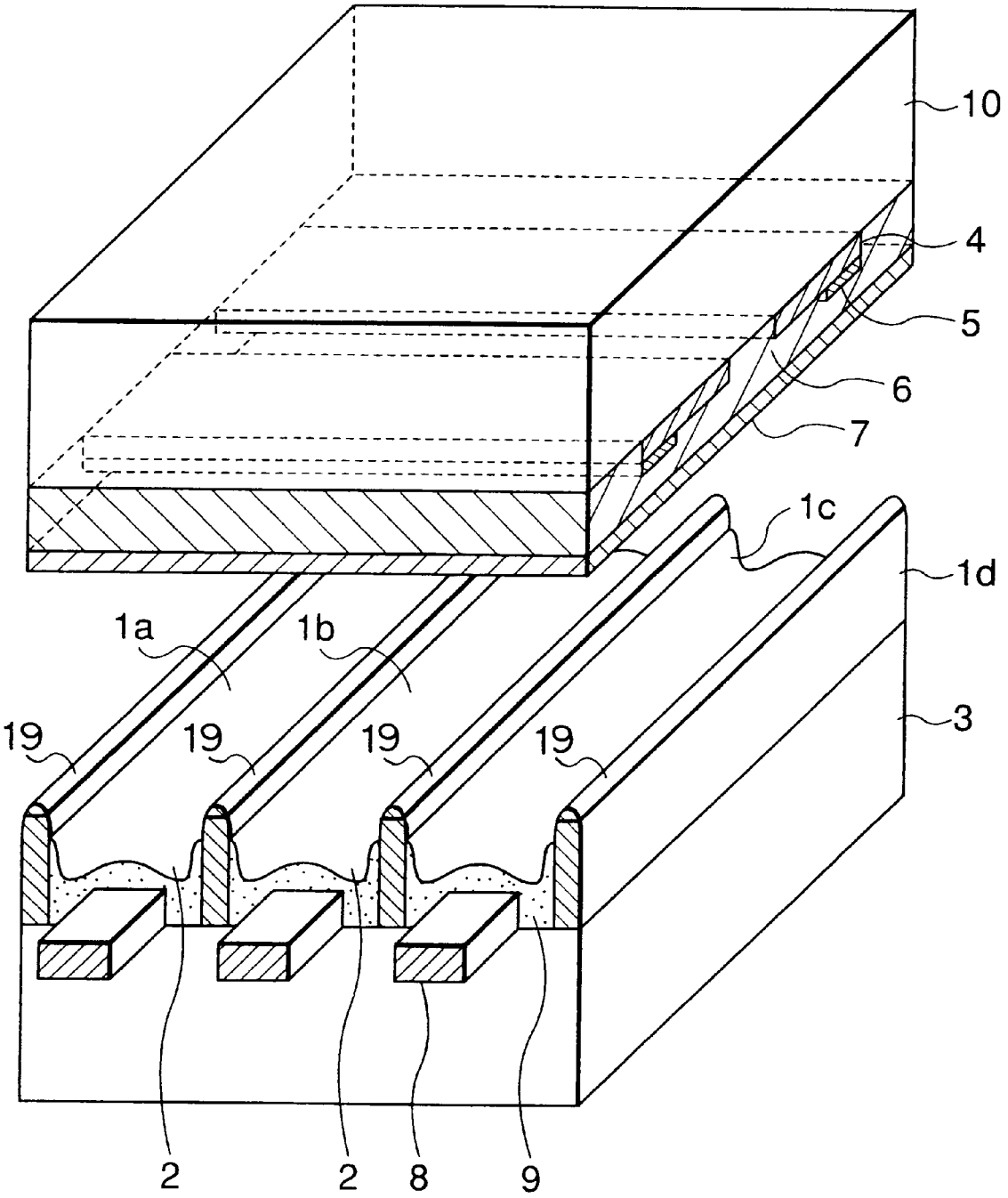
FIG. 1 is an enlarged fragmentary exploded typical perspective view of a plasma display panel in a first embodiment according to the present invention.

An ac PDP(plasma display panel) in a first embodiment according to the present invention will be described with reference to FIGS. 1 to 3. Referring to FIG. 1 showing the ac PDP in an exploded perspective view, a back plate 3 made of glass and a front plate 10 made of glass are disposed in parallel and opposite to each other. The back plate 3 and the front plate 10 are spaced a predetermined distance apart from each other by a plurality of parallel partition walls formed on the inner surface of the back plate 3. Only partition walls (barrier ribs) 1*a*, 1*b*, 1*c* and 1*d* among all the plurality of parallel partition walls are shown in the drawings. The partition walls 1*a*, 1*b*, 1*c* and 1*d* define discharge spaces 2 between the plates 3 and 10. Parallel composite electrodes each consisting of a transparent electrode 4 and a metal bus electrode 5 are formed on the inner surface of the front plate 10, and a dielectric glass layer 6 and a protective layer 7 of MgO are formed in that order on the inner surface of the front plate 10 so as to cover the composite electrodes.

Parallel address electrodes 8 are formed between the partition walls 1*a*, 1*b*, 1*c* and 1*d* on the inner surface of the back plate 3 perpendicularly to the composite electrodes 4, 5. Phosphor layers 9 respectively containing phosphor materials are formed on the side surfaces of the partition walls 1*a*, 1*b*, 1*c* and 1*d*, and portions of the inner surface of the back plate 3 defining the bottoms of the discharge spaces 2. The ac PDP is of a surface discharge type in which an ac voltage is applied to the composite electrodes each consisting of the transparent electrode 4 and the bus electrode 5 to produce a discharge by an electric field created in the discharge spaces 2. The direction of the electric field changes at a frequency corresponding to that of the ac voltage. The phosphor layers 9 are energized by UV rays produced by discharge to emit light, which is visible through the front plate 10.

The address electrodes 8 are formed on the back plate 3 and, if necessary, the address electrodes 8 are covered with dielectric layers, not shown, respectively. The partition walls 1*a*, 1*b*, 1*c* and 1*d* are formed on the inner surface of the back plate 3 and the phosphor layers 9 are formed on the portions of the inner surface of the back plate 3 between the partition walls 1*a*, 1*b*, 1*c* and 1*d*. The address electrodes 8 may be formed by depositing a conductive film on the inner surface of the back plate 3 by a vacuum evaporation process, a sputtering process, a plating process, a thick-film process or the like and patterning the conductive film by a photolithographic process or by printing a conductive paste in a thick film of a desired pattern by a printing process. The dielectric layer is formed by a screen printing process or the like. The partition walls 1*a*, 1*b*, 1*c* and 1*d* are formed by a screen overprinting process or a sand blasting process. The R (red), the G (green) and the B (blue) phosphor layers 9 are formed in the discharge spaces 2 between the partition walls 1*a*, 1*b*, 1*c* and 1*d* by selectively filling an R phosphor paste, a G phosphor paste and a B phosphor paste in the discharge spaces 2 or by a photolithographic process using photosensitive phosphor pastes.

Thus, the back plate 3 and the front plate 10 are disposed in parallel and opposite to each other, the plurality of discharge cells are formed in the discharge spaces 2 demarcated by the partition walls 1*a*, 1*b*, 1*c* and 1*d*, and the phosphor layers 9 are formed at predetermined positions in the discharge cells, respectively. The partition walls 1*a*, 1*b*, 1*c* and 1*d* are formed of a material containing at least one of R, G and B pigments. Black layers 19 are formed on the top surfaces of the partition walls 1*a*, 1*b*, 1*c* and 1*d* to reduce the reflection of external light by the top surfaces so that the PDP is able to display pictures in improved contrast.

The necessary quantity of the R phosphor paste is reduced if a material containing an R pigment is used, the necessary quantity of the G phosphor paste is reduced if a material containing a G pigment is used, or the necessary quantity of the B phosphor paste is reduced if a material containing a B pigment is used for forming the partition walls 1*a*, 1*b*, 1*c* and 1*d*.

A paste generally used for forming such partition walls contains glass frit and a binder resin as principal components, a filler and an inorganic pigment as inorganic components in addition to the glass frit, and at least one of R, G and B pigments. The paste may contain a white pigment, such as titanium oxide, aluminum oxide, silica, calcium carbonate or the like. The content of the white pigment is in the range of about 5 to about 20 parts by weight for 100 parts by weight of the glass frit.

Representative pigments among those suitable for coloring the partition walls 1*a*, 1*b*, 1*c* and 1*d* are iron (Fe) pigments (red), manganese aluminate pigments (pink), gold (Au) pigments (pink), antimony-titanium-chromium (Sb—Ti—Cr) pigments (orange), iron-chromium-zinc (Fe—Cr—Zn) pigments (yellowish brown), iron (Fe) pigments (brown), titanium-chromium (Ti—Cr) pigments (yellowish brown), iron-chromium-zinc (Fe—Cr—zn) pigments (yellowish brown), iron-antimony (Fe—Sb) pigments (yellowish brown), antimony-titanium-chromium (Sb—Ti—Cr) pigments (yellow), zinc-vanadium (An—V) pigments (yellow), zirconium-chromium (Zr—Cr) pigments (green), cobalt (Co) pigments (blue), cobalt aluminate (Co—Al) pigments (blue), vanadium-zirconium (V—Zr) pigments (blue) and cobalt-chromium-iron (Co—Cr—Fe) pigments (black). These pigments may be individually used or some of these pigments may be used in combination to develop a color of a desired color tone.

The black layers 19 are formed on the top surfaces of the partition walls 1*a*, 1*b*, 1*c* and 1*d* by applying a paste containing a black inorganic pigment, such as one of Co—Cr—Fe, Co—Mn—Fe, Co—Fe—Mn—Al, Co—Ni—Cr—Fe, Co—Ni—Mn—Cr—Fe, Co—Al—Cr—Fe, Co—Mn—Al—Cr—Fe—Si, Cu—Cr—Fe pigments. The black pigment content is in the range of about 5 to about 20 parts by weight for 100 parts by weight of the glass frit.

The black paste for forming the black layers 19 may contain a filler if necessary. The filler is used for preventing the flow of paste layers during burning and enhancing the compactness of the black layers 19. The filler is an inorganic powder of a mean particle size in the range of 0.1 to 20 $\mu$m having a softening point higher than that of the glass frit, such as powder of aluminum oxide, boron oxide, silica, titanium oxide, magnesium oxide, calcium oxide, strontium oxide, barium oxide, calcium carbide, zirconia or zircon. A preferable inorganic powder content is in the range of 0 to 30 parts by weight for glass frit content of 100 parts by weight.

The binder resin is used for binding the inorganic components. The binder resin is a polymer of one of or a copolymer of some of methyl acrylate, methyl methacrylate, ethyl acrylate, ethyl methacrylate, n-propyl acrylate, n-propyl methacrylate, isopropyl acrylate, isopropyl methacrylate, sec-butyl acrylate, isobutyl acrylate, isobutyl methacrylate, tert-butyl acrylate, tert-butyl methacrylate, n-pentyl acrylate, n-pentyl methacrylate, n-hexyl acrylate, n-hexyl methacrylate, 2-ethylhexyl acrylate, 2-ethylhexyl methacrylate, n-octyl acrylate, n-octyl methacrylate, n-decylacrylate, n-decyl methacrylate, hydroxyethyl acrylate, hydroxyethyl methacrylate, hydroxypropyl acrylate, hydroxypropyl methacrylate, styrene, $\alpha$-methyl styrene and N-vinyl-2-pyrrolidone, a cellulose derivative, such as ethyl cellulose, or one of water-soluble resins including polyvinyl alcohol, poly-N-vinyl pyrrolidone, hydroxyethyl cellulose, hydroxypropyl cellulose, methyl cellulose, carboxymethyl cellulose and casein.

The paste for forming the partition walls is prepared by dissolving or dispersing partition wall forming materials in a solvent. The paste is applied to the back plate 3 in the shapes of the partition walls and dried. The solvent is one of methanol, ethanol, isopropanol, aceton, methyl ethyl ketone, toluene, xylene, anones, such as cyclohexanone, methylene chloride, 3-methoxybutyl acetate, ethylene glycol monoalkylethers, ethylene glycol alkylether acetates, diethylene glycol monoalkylethers, diethylene glycol monoalkylether acetates, propylene glycol monoalkylether acetates, dipropylene glycol monoalkylethers, dipropylene glycol monoalkylether acetates, and terpenes including $\alpha$- or $\beta$-terpineol. If necessary, the partition wall forming paste may contain a plasticizer, a dispersant, a sedimentation inhibitor, a defoaming agent, a leveling agent and/or a thickener.

The phosphor paste for forming the phosphor layers 9 contains a phosphor substance and a resin as principal components. The same solvent as that used for preparing the partition wall forming paste may be used for preparing the phosphor paste. The phosphor paste, similarly to the partition wall forming paste, prepared by dissolving or dispersing the component materials in the solvent is applied to the back plate 3 in the phosphor layers 9 and dried.

Suitable red phosphor substances which emit red light are $Y_2O_3$/Eu, $Y_2SiO_5$/Eu, $Y_3Al_5O_{12}$/Eu, $Zn_3(PO_4)_2$/Mn, $YBO_3$/Eu, (Y, Gd)$BO_3$/Eu, $GdBO_3$/Eu, $ScBO_3$/Eu and $LuBO_3$/Eu. Suitable green phosphor substances which emit green light are $Zn_2SiO_4$/Mn, $BaAl_{12}O_{19}$/Mn, $SrA_{13}O_{19}$/Mn, $CaAl_{12}O_{19}$/Mn, $YBO_3$/Tb, $BaMgAl_{14}O_{23}$/Mn, $LuBO_3$/Tb, $GdBO_3$/Tb, $ScBO_3$/Tb and $Sr_6Si_3O_3Cl_4$/Eu. Suitable blue phosphor materials which emit blue light are $Y_2SiO_5$/Ce, $CaWO_4$/Pb, $BaMgAl_{10}O_{17}$/Eu and $BaMgAl_{14}O_{23}$/Eu.

The partition walls 1*a*, 1*b*, 1*c* and 1*d* may be formed by a conventional method. Representative methods suitable for forming the partition walls 1*a*, 1*b*, 1*c* and 1*d* are a first method which applies the partition wall forming paste by a screen overprinting process to the back plate 3 in partition wall forming layers and dries the partition wall forming layers, a second method which forms partition wall forming layers of the partition wall forming paste on the back plate 3 by a coating process or a transfer process, covers the partition wall forming layers with a mask capable of withstanding sand blasting, removes unnecessary portions of the partition wall forming layers by sand blasting, and burns the partition wall forming layers, and a third method which forms a resist film having openings corresponding to the partition walls 1*a*, 1*b*, 1*c* and 1*d* on the inner surface of the back plate 3, fills up the openings with the partition wall forming paste to form partition wall forming layers, removes the resist film, and then burns the partition wall forming layers.

The phosphor layers 9 may be formed by a conventional method. Suitable methods for forming the phosphor layers 9 are (1) a screen printing method which prints the phosphor paste in phosphor paste layers corresponding to the phosphor layers 9 by screen printing, (2) a photographic method which forms phosphor paste layers corresponding to the phosphor layers 9 by a photographic process using a phosphor paste prepared by dispersing a phosphor substance in a photosensitive slurry, (3) a tungsten method which wets the inner surface of the back plate 3 with a photosensitive liquid, sprinkles the surface of the back plate 3 wetted with the photosensitive liquid with a phosphor powder before the photosensitive liquid dries to form a phosphor powder layer, exposes the phosphor powder layer to light for patterning, (4) a photoadhesion method which forms a layer of a material which becomes adhesive when exposed to UV rays on the inner surface of the back plate 3, irradiates the layer with UV rays in a pattern corresponding to the phosphor layers 9 to form adhesive layers, and sprinkles the adhesive layers with a phosphor powder, and (5) a sand blast method which fills up the cells with a phosphor paste in layers, and then removes unnecessary portions of layers by sand blasting to form the phosphor layers on the bottoms of the cells and the side surfaces of the partition walls 1*a*, 1*b*, 1*c* and 1*d*.

EXAMPLES

An ac PDP in a first example will be described hereinafter in connection with an ac PDP fabricating process.

Figure 2:
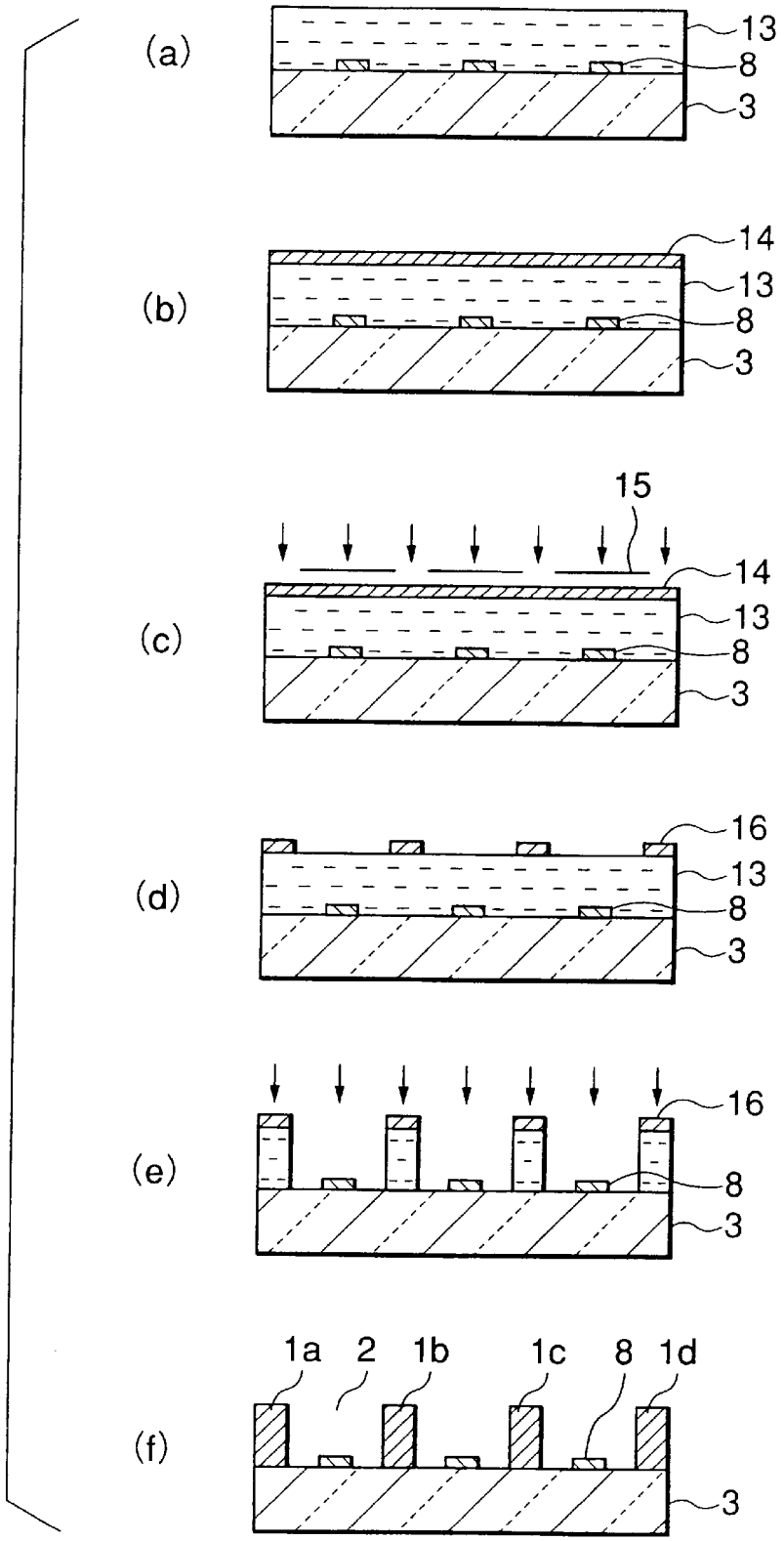
FIG. 2 is a typical view of assistance in explaining a procedure for forming partition walls on a back plate of the plasma display panel of FIG. 1.

Referring to FIGS. 2(*a*), address electrodes 8 were formed on an inner surface of a back plate 3. If necessary, a dielectric layer, not shown, may be formed over the address electrodes 8. Then, a partition wall forming layer 13 of 180 μm in thickness was formed by spreading a partition wall forming paste of the following composition by a blade coater in a paste layer of 420 μm in thickness on the inner surface of the back plate 3, and drying the paste layer at 150° C. for 50 min.

Composition of the partition wall forming paste

Glass frit: $PbO—B_2O_3—SiO_2$, 70% by weight

Red pigment: $\alpha—Fe_2O_3$ acicular powder (TOR available from Dainichi Seika Kogyo), 10% by weight Binder: Cellulose resin, 2% by weight Solvent: Terpineol, 10% by weight Then, the back plate 3 was heated at 80° C. and a dry resist film (NCP225, available from Nippon Gosei Kagaku Kogyo) was laminated to the back plate 3 to form a mask layer 14 as shown in FIG. 2(*b*). Subsequently, a line pattern mask 15 provided with 50 μm wide linear slits arranged at pitches of 150 μm was put on the mask layer 14, and the mask layer 14 was exposed to UV rays of 360 nm in wavelength and of 200 $\mu W/cm^2$ in intensity through the line pattern mask 15 at 120 $mJ/cm^2$ in exposure. Then, as shown in FIG. 2(*d*), the surface of the exposed mask layer 14 was sprayed with a 1% by weight sodium carbonate solution of 30° C. for spray development to form a sand blasting mask 16 having 50 μm wide lines arranged at pitches of 150 μm.

Then, as shown in FIG. 2(*e*), the partition wall forming layer 13 covered with the sand blasting mask 16 was subjected to a sand blasting process to remove unnecessary portions of the partition wall forming layer 13. In the sand blasting process, #800 alumina powder as an abrasive was blasted at an abrasive blasting rate of 100 g/min and at a blasting pressure of 3 $kgf/cm^2$ by a blasting nozzle spaced a distance of 100 mm from the surface of the back plate 3 and moved at a velocity of 10 mm/sec. After the completion of the sand blasting process, the sand blasting mask 16 was removed with a remover. The remover was a 2% by weight sodium hydroxide solution of 30° C. After the sand blasting mask 16 had been removed, the back plate 3 was burned at a peak temperature of 570° C. for 20 min to form partition walls 1*a*, 1*b*, 1*c* and 1*d* defining discharge spaces 2 on the back plate 3 a shown in FIG. 2(*f*). Then, electrodes 8 were formed on the back plate 3.

Subsequently, the R, G and B phosphor pastes were filled sequentially in the predetermined cells in the discharge space 2. First the R phosphor paste was filled in the predetermined cells in R phosphor paste layers by screen printing so as to coat the bottom surfaces of the cells, i.e., portions of the inner surface of the back plate 3, and the opposite side surfaces of the adjacent partition walls demarcating the cells (the partition walls 1*a* and 1*b* in FIGS. 3(*a*) and 3(*b*)), the R phosphor paste layers were subjected to a drying process to remove the solvent from the R phosphor paste layers so that R phosphor layers 18(R) are formed. Then the same processes were repeated for the G phosphor paste and the B phosphor paste to form G phosphor layers 18(G) and B phosphor layers 18(B) on the bottom surfaces of the corresponding cells, i.e., portions of the inner surface of the back plate 3, and the opposite side surfaces of the adjacent partition walls demarcating the cells (the partition walls 1*b* and 1*c*, and the partition walls 1*c* and 1*d* in FIGS. 3(*a*) and 3(*b*)).

In this example, red phosphor powder of $(Y, Gd)BO_3/Eu$ (KX-504A available from Kasei Oputonikusu), green phosphor powder of $Zn_2SiO_4/Mn$ (PI-G1S available from Kasei Oputonikusu) and blue phosphor powder of $BaMgAl_{10}O_{17}/Eu$ (KX-501A available from Kasei Oputonikusu) were used. Each of the phosphor paste was prepared by mixing 50% by weight phosphor powder, 4.2% by weight ethyl cellulose (resin) and 45.8% by weight terpineol (solvent) and had a viscosity of 400 P.

The phosphor layers were subjected to a burning process to burn the same at 450° C. for 30 min to burn out the organic components. Thus, the back plates 3 provided with the R, G and B phosphor layers 9 arranged in a predetermined pattern was completed.

The back plate 3 provided with the phosphor layers 9 and a front plate 10 were combined to assemble a surface discharge ac color PDP. The respective luminances of the R, G and B discharge spaces were substantially the same and satisfactorily high, and the white balance of the surface discharge ac color PDP was satisfactory.

The PDP in accordance with the present invention is provided with the partition walls formed of the partition wall forming material containing at least one of R, G and B pigments. Therefore, the selection of types and the determination of the quantity of the phosphor substances, the determination of the shape (thickness) of the phosphor layers and the adjustment of the related circuit are facilitated, the pigment or pigments contained in the partition wall forming material contribute to the adjustment of the respective luminances of the R, G and B phosphor layers and the adjustment of white balance, so that any additional material, such as a dispersant, and any additional processes are unnecessary, which enables the manufacture of the PDP at a relatively low cost.

Second Embodiment

Figure 3:
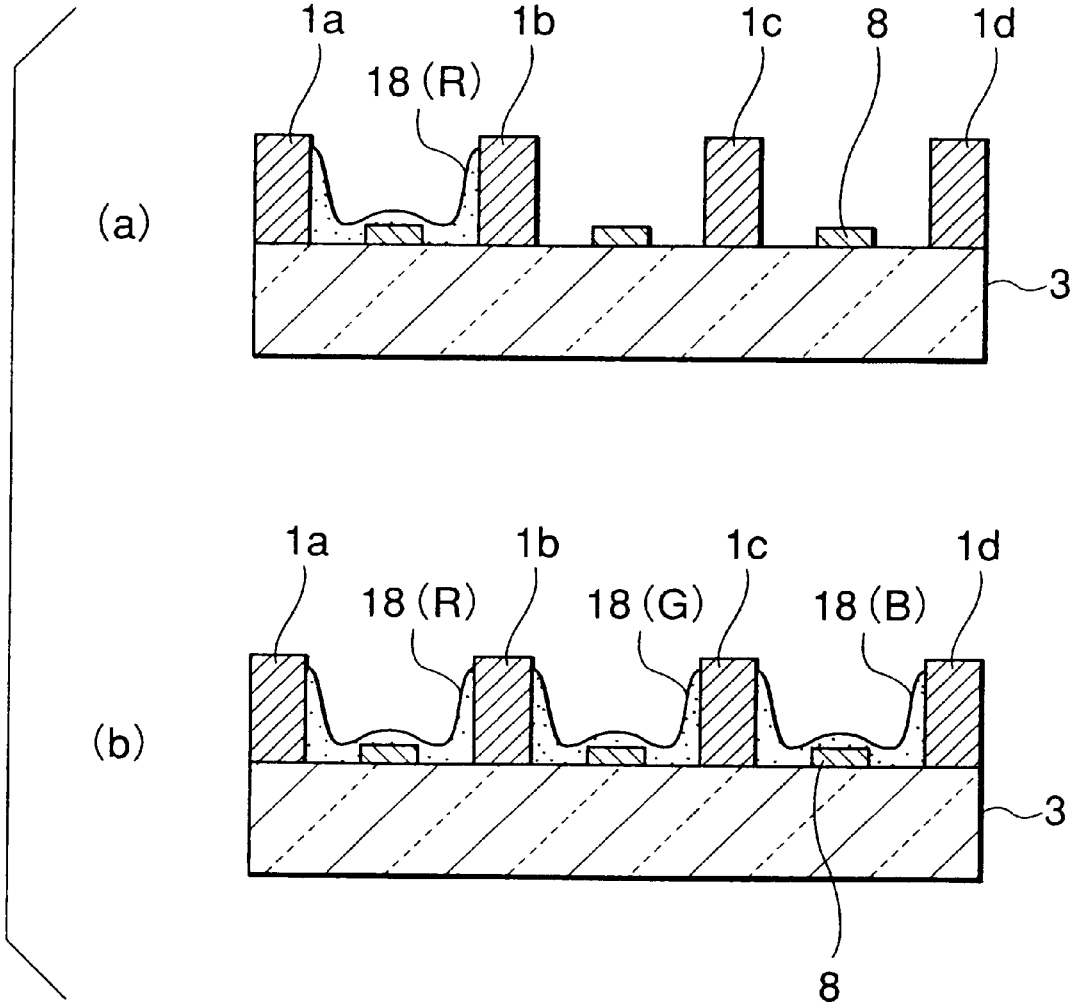
FIG. 3 is a typical view of assistance in explaining a procedure for forming phosphor layers on the side surfaces of the partition walls and the inner surface of the back plate.

A PDP (plasma display panel) in a second embodiment according to the present invention will be described hereinafter with reference to FIGS. 4 to 9, in which parts like or corresponding to those of the first embodiment shown in FIGS. 1 to 3 are designated by the same reference characters and the detailed description thereof will be omitted.

Figure 4:
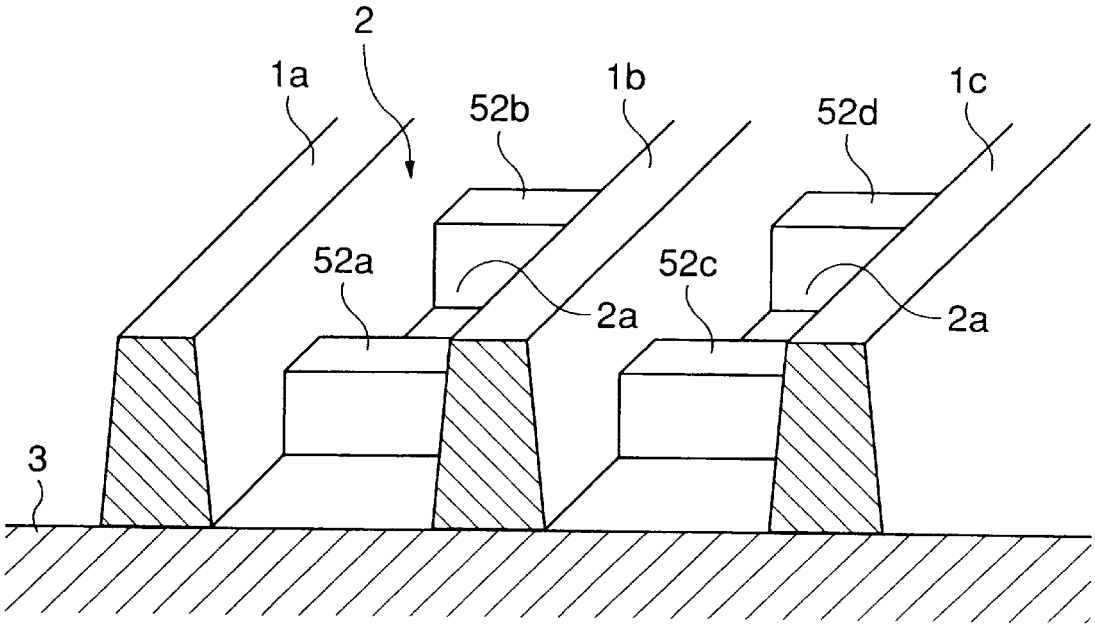
FIG. 4 is an enlarged fragmentary typical perspective view of partition walls included in a plasma display panel in a second embodiment according to the present invention.

Referring to FIG. 4, the PDP has a back plate 3 provided with a plurality of parallel partition walls, and auxiliary partition walls extended perpendicularly to the partition walls between the adjacent partition walls. In FIG. 4, only the partition walls (barrier ribs) 1*a*, 1*b* and 1*c* among the plurality of partition walls, and only the partition walls 52*a*, 52*b*, 52*c* and 52*d* among the auxiliary partition walls are shown. Address electrodes 8 (FIG. 1) are extended in parallel to the partition walls 1*a*, 1*b* and 1*c* on portions of the inner surface of the back plate 3 defining bottoms of discharge spaces 2 formed between the adjacent partition walls 1*a* and 1*b* and between the adjacent partition walls 1*b* and 1*c*. Although the partition walls 1*a*, 1*b* and 1*c* shown in FIG. 4, 5 have a trapezoidal cross section, the partition walls 1*a*, 1*b* and 1*c* may have a cross section of any suitable shape, such as a rectangular shape or a shape defined by curves. Bus lines 5 (FIG. 1) are formed in parallel to the auxiliary partition walls 52*a*, 52*b*, 52*c* and 52*d*. The auxiliary partition walls 52*a*, 52*b*, 52*c* and 52*d* have a substantially trapezoidal or rectangular cross section. In a modification of the PDP of FIG. 4 shown in FIG. 5, auxiliary partition walls 54*a*, 54*b*, 54*c* and 54*d* have each opposite curved side surfaces 55 diverging toward the inner surface of the back plate 3.

The auxiliary partition walls 52*a*, 52*b*, 52*c* and 52*d* (54*a*, 54*b*, 54*c* and 54*d*) divide the discharge spaces 2 formed between the adjacent partition walls 1*a*, 1*b* and 1*c* into separate discharge spaces 2*a*, i.e., separate discharge cells in each of which the address electrode 8 and the bus electrode 5 extend spatially across each other. As shown in FIG. 4 (FIG. 5), the partition walls 1*a*, 1*b* and 1*c* and the auxiliary partition walls 52*a*, 52*b*, 52*c* and 52*d* (the auxiliary partition walls 54*a*, 54*b*, 54*c* and 54*d*) define the separate discharge spaces 2*a*, i.e., discharge cells. The light emitting area of phosphor layers 9 (FIG. 1) formed on the surfaces of the partition walls 1*a*, 1*b* and 1*c* and the auxiliary partition walls 52*a*, 52*b*, 52*c* and 52*d* (54*a*, 54*b*, 54*c* and 54*d*) is greater than that of the phosphor layers formed only on the surfaces of the partition walls 1*a*, 1*b* and 1*c*. Therefore, UV rays act efficiently on the phosphor layers 9 to make the phosphor layers 9 emit light in a high luminance.

The auxiliary partition walls 52*a*, 52*b*, 52*c* and 52*d* (54*a*, 54*b*, 54*c* and 54*d*) prevent or reduce the leakage of a discharge produced in one separate discharge space 2*a* and UV rays produced by the discharge into the adjacent separate discharge space 2*a*. Therefore, the separate discharge spaces 2*a* can be individually controlled for light emission, so that pictures can be displayed in a high picture quality.

Figure 5:
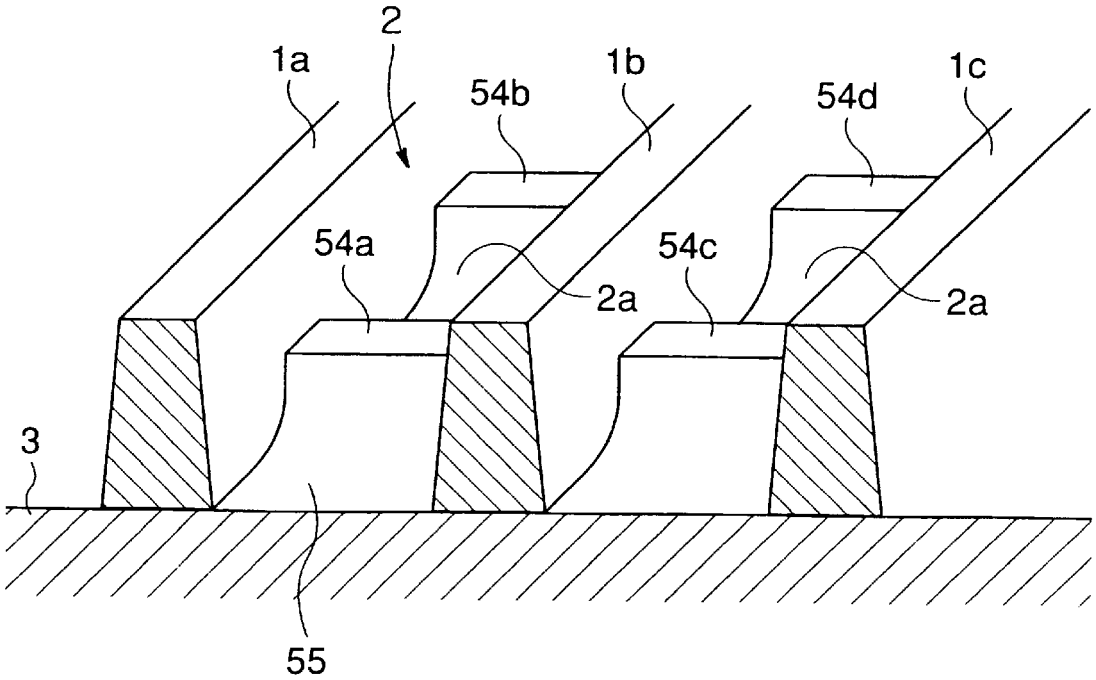
FIG. 5 is an enlarged fragmentary typical perspective view of partition walls in a modification of the partition walls shown in FIG. 4.

As mentioned above, the auxiliary partition walls 54*a*, 54*b*, 54*c* and 54*d* shown in FIG. 5 have each the opposite curved side surfaces 55 diverging toward the inner surface of the back plate 3. The auxiliary partition walls 54*a*, 54*b*, 54*c* and 54*d* having such opposite curved side surfaces 55 increase the ratio in quantity of light rays that travel toward the front plate 10 to the total light rays emitted by the phosphor layers 9, which enhances the apparent luminance of the separate discharge spaces 2*a*. Since the base portions of the auxiliary partition walls 54*a*, 54*b*, 54*c* and 54*d* have an enlarged area, a structure including the partition walls 1*a*, 1*b* and 1*c* and the auxiliary partition walls 54*a*, 54*b*, 54*c* and 54*d* has an enhanced strength. Accordingly, the partition walls 1*a*, 1*b* and 1*c* and the auxiliary partition walls 54*a*, 54*b*, 54*c* and 54*d* may be formed in a relatively small width, so that the separate discharge spaces 2*a* can be formed in a relatively large volume, which improves discharge efficiency. Since pixels can be arranged at relatively small pitches, the PDP can be constructed in a high-definition PDP.

Usually, the auxiliary partition walls 52*a*, 52*b*, 52*c*, 52*d*, 54*a*, 54*b*, 54*c* and 54*d* are formed in a height lower than that of the partition walls 1*a*, 1*b* and 1*c* as illustrated in FIGS. 4 and 5. UV rays act efficiently on the phosphor layers 9 to make the phosphor layers 9 emit light in a high luminance and the leakage of discharge took place in one of the separate discharge spaces 2*a* into the adjacent separate discharge space 2*a* can be prevented if the height of the auxiliary partition walls 52*a*, 52*b*, 52*c*, 52*d*, 54*a*, 54*b*, 54*c* and 54*d* is in the range of ½ to ⅚ of that of the partition walls 1*a*, 1*b* and 1*c*. When the auxiliary partition walls 52*a*, 52*b*, 52*c*, 52*d*, 54*a*, 54*b*, 54*c* and 54*d* are formed in such a height, the phosphor layers 9 can be easily formed.

A method of forming the partition walls 1*a*, 1*b* and 1*c* and the auxiliary partition walls 52*a*, 52*b*, 52*c* and 52*d* (54*a*, 54*b*, 54*c* and 54*d*) will be described below by way of example.

Figure 6:
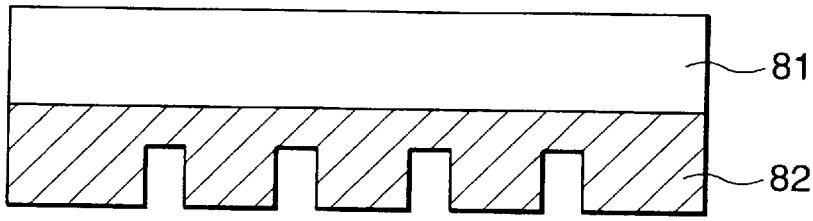
FIG. 6 is a typical sectional view of a base film provided with a pattern layer having recesses.
Figure 7:
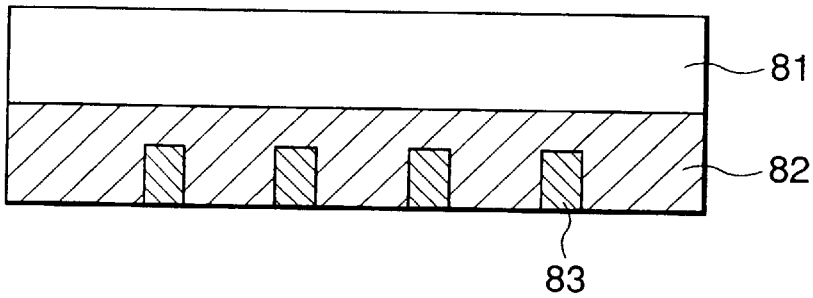
FIG. 7 is a typical sectional view of a transfer sheet.
Figure 8:
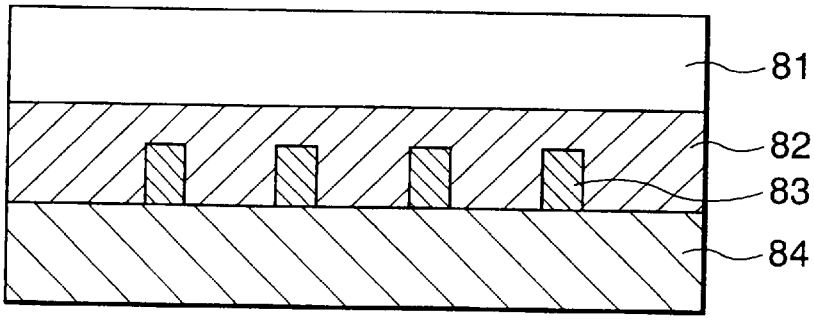
FIG. 8 is a typical sectional view of assistance in explaining a method of forming partition walls and auxiliary partition walls.
Figure 9:
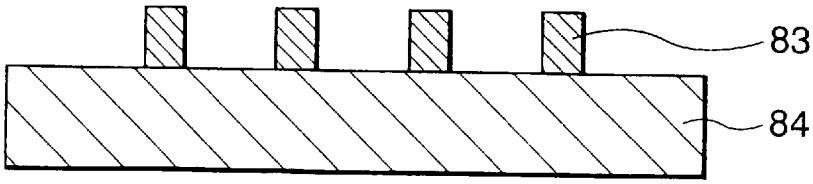
FIG. 9 is a typical sectional view of partition walls and auxiliary partition walls formed by transfer printing.

FIG. 6 is a sectional view of a base film 81 provided with a pattern layer 82 having recesses for forming the partition walls arranged in a predetermined pattern in one surface thereof, FIG. 7 is a sectional view of a transfer printing sheet carrying a paste layer for forming the partition walls in the recesses of the pattern layer 82, and FIGS. 8 and 9 are sectional views of assistance in explaining a patterned layer forming method using the transfer printing sheet shown in FIG. 7. Although the patterned layer forming method is applicable not only to forming partition walls but also to forming base layers, electrodes and dielectric layers in a desired pattern, the patterned layer forming method will be described as applied to forming partition walls herein. Shown in FIGS. 6 to 9 are a base film 81, a pattern layer 82 provided with recesses arranged in a predetermined pattern, a paste layer 83, and a base member 84 to which the paste layer 83 is to be transferred by transfer printing to form partition walls.

The base film 81 is a film which will not be affected by the solvent contained in the paste layer 83 and will neither contract nor elongate when exposed to heat during operation. The base film 81 is a sheet or a film of a plastic material, such as polyethylene terephthalate, or a foil of a metal, such as aluminum or copper. The thickness of the base film 81 is, for example, in the range of 100 to 300 $\mu$m.

The pattern layer 82 formed on the base sheet 81 is has recesses formed in a pattern of partition walls to be formed by using the transfer printing sheet; that is the shape of the recesses is complementary to that of the partition walls 1*a*, 1*b* and 1*c* shown in FIG. 4 (FIG. 5). The recesses may be formed in a surface of the base film 81 by embossing or etching, or the base film 81 may be such as formed by molding and provided with the recesses formed by molding. Preferably, the recesses are formed by printing a curable resin in a pattern having recesses of a pattern equal to that of the recesses to be formed on the base film 81 with a gravure printing cylinder.

Figure 10:
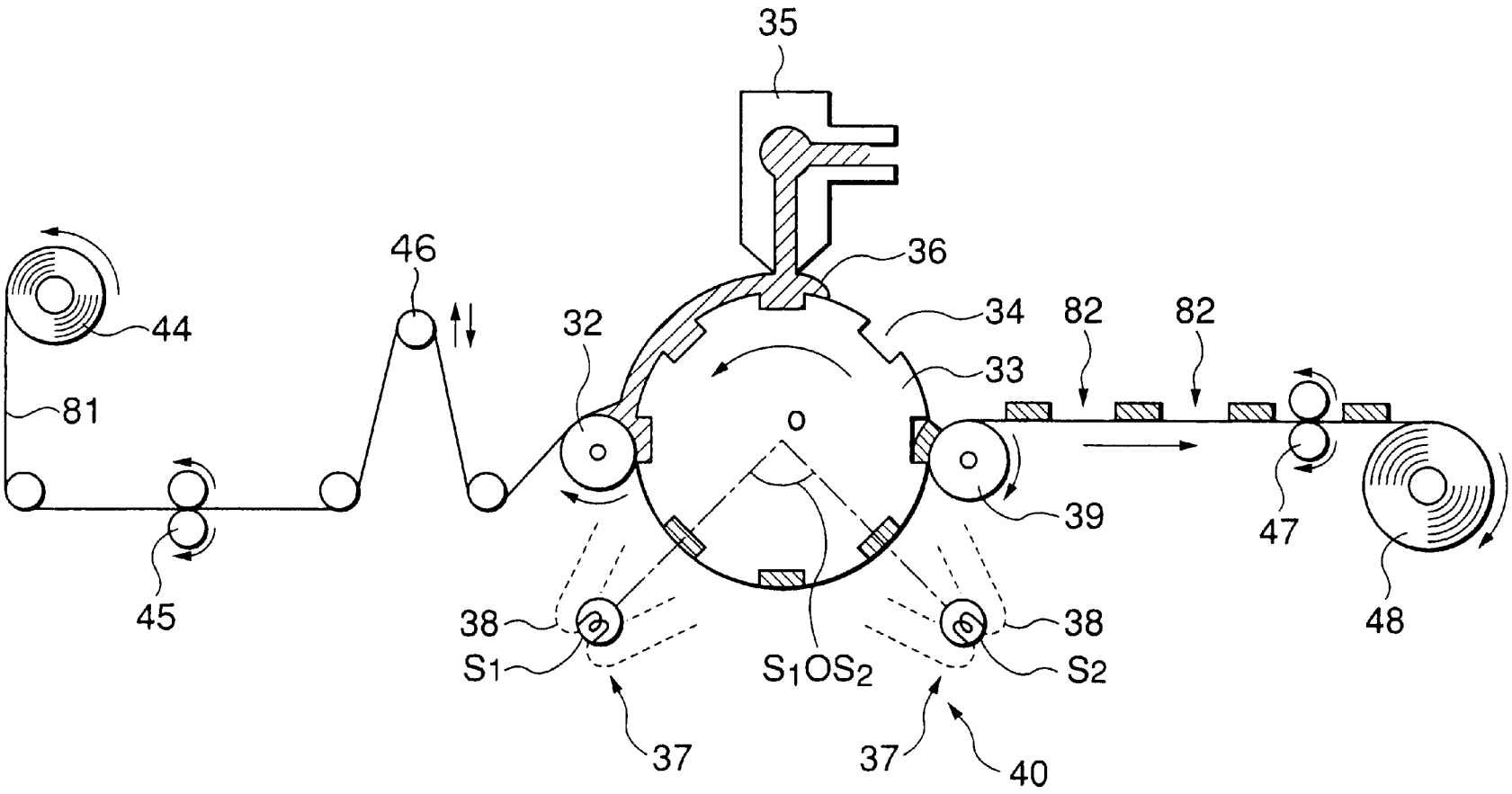
FIG. 10 is a diagrammatic view of assistance in explaining a method of forming a base film using a gravure printing cylinder.

Referring to FIG. 10 showing a recess forming apparatus, there are shown the base film 81, the pattern layer 82, a gravure printing cylinder 33, recesses 34, a resin feeding device 35, a curable resin 36, a hardening device 37, a separating roller 39, a coating unit 40, a base film roll 44, a feed roller 45, a compensator roller 46, a take-up roller 47 and a transfer sheet roll 48. The coating unit 40 has the gravure printing cylinder 33 provided with the recesses 34, the resin feed device 35 for feeding a liquid curable resin 36 so as to coat the circumference of the gravure printing cylinder 33, a pressure roller 32 for pressing the base film 81 against the circumference of the gravure printing cylinder 33 coated with the liquid curable resin 36, hardening devices for hardening the liquid curable resin coating the circumference of the gravure printing cylinder 33 and filling up the recesses 34 of the gravure printing cylinder 33, and the separating roller 39 for separating a transfer printing sheet formed by laminating the base film 81 and a layer of the resin 36 from the gravure printing cylinder 33. The gravure printing cylinder 33 is driven through a driving mechanism, not shown, by an electric motor or the like for rotation at a surface velocity equal to a feed speed at which the base film 81 is fed. The curable resin 36 filling up the recesses 34 of the gravure printing cylinder 33 and covered with the base film 81 pressed against the circumference of the gravure printing cylinder 33 is hardened in the recesses 34 by the hardening devices 37 so that the curable resin 36 adheres to the base film 81. The transfer printing sheet thus formed by bonding the hardened curable resin 36 to the base film 81 is separated from the gravure printing cylinder 33 by the separating roller 39, and the transfer printing sheet is taken up in the transfer printing sheet roll 48. The hardened curable resin 36 bonded to the transfer sheet 81 form the pattern layer 82 provided with recesses in a predetermined pattern.

The pressure roller 32 may be a roller of any suitable dimensions and a suitable construction provided that the roller is able to press the base film 81 against the circumference of the gravure printing cylinder 33. Usually, the pressure roller 32 has a diameter in the range of about 50 to about 300 mm and is formed by coating a metal core with an annular layer of silicone rubber, natural rubber or the like.

The type of the hardening device 37 may be determined according to the properties of the curable resin 36. For example, the hardening device 37 is a device capable of irradiating the curable resin 36 with radiations having energy capable of causing bridge formation and polymerization in the curable resin 36 among electromagnetic radiations or charged particle beams. Industrially available radiations are infrared rays, visible rays, ultraviolet rays, electron beams, and electromagnetic radiations, such as microwaves and X-rays. In FIG. 10, indicated at 38 is a reflecting mirror for efficiently projecting radiations emitted by a radiation source on the gravure printing cylinder 33. The two hardening devices 37 have radiation sources S1 and S2 disposed on lines meeting on the center axis O of the gravure printing cylinder 33 so as to form an angle S1OS2 in the range of 70° to 110°. Preferably, the angle S1OS2 is 90° C.

The recesses 34 of the gravure printing cylinder 33 may be formed by electronic photoengraving, etching, mill pressing or electroforming. The gravure printing cylinder 33 is a chromium plated cylinder of a metal, such as copper or iron, a cylinder of a ceramic material, such as glass or quartz, or a cylinder of a synthetic resin, such as an acrylic resin or a silicone resin. The gravure printing cylinder 33 may be formed by winding a sheet provided with a solid pattern of an ionizing-radiation-setting resin or a thermosetting resin round a cylinder.

Although there is not any particular restriction on the dimensions of the gravure printing cylinder 33, usually, the gravure printing cylinder 33 has a diameter in the range of about 150 to about 1000 mm and a length in the range of about 300 to about 2000 mm. The dimensions of the recesses 34 of the gravure printing cylinder 33 are equal to those of protrusions to be formed on the base film 81. The base film 81 is made of a material which does not obstruct the travel of radiations through the base film 81 to the surface of the curable resin coating the circumference of the gravure printing cylinder 33.

The curable resin may be a well-known thermosetting resin or an ionizing-radiation-setting resin, such as a UV curable resin or an electron beam curable resin. The curable resin may be a composition prepared by properly mixing a prepolymer having molecules having polymerizing unsaturated bonds or epoxy groups, an oligomer and/or a monomer. Suitable prepolymers and oligomers are unsaturated polyester resins, such as a condensate of unsaturated dicarboxylic acid and a polyhydric alcohol, epoxy resins, methacrylate resins including polyester methacrylate resins, polyether methacrylate resins, and polyol methacrylate resins, and acrylate resins including polyester acrylate resins, polyether acrylate resins and polyol acrylate resins.

The monomers are compounds having at least one polymerizing unsaturated carbon/carbon bond, such as allyl acrylate resins, benzyle acrylate resins, butoxyethylene glycol acrylate resins, cyclohexyl acrylate resins, dicyclopentanyl acrylate resins, dicyclopentenyl acrylate resins, 2-ethylhexyl acrylate resins, glycerol acrylate resins, and mixtures of some of those resins.

The UV curable resin is prepared by mixing the foregoing composition and a photopolymerization initiator. A combination of a photoreduction dye, such as benzophenone, o-benzoyl methylbenzoate, 4,4-bis(dmethylamino) benzophenone, 4,4-bis(diethylamono) benzophenone, (-aminoacetophenone, 4,4-dichlorobenzophenone, 4-benzoyl-4-methyl diphenylketone, 1-dibenzylketone, fluorenone, 2,2-diethoxyacetophenone, 2,2-dimethoxy-2-phenylacetophenone, methylene blue or the like, and a reducing agent such as ascorbic acid, triethanolamine or the like. The foregoing photopolymerization initiators may be used individually or in combination.

The transfer printing sheet thus formed by laminating the pattern layer 82 to the base film 81 may be a flat sheet as shown in FIG. 6 or an endless sheet. If necessary, a releasing layer may be formed over the surface of the pattern layer 82 laminated to the base film 81 or the material forming the base film 81 or the curable resin forming the pattern layer 82 may contain a releasing agent to facilitate the separation of the paste layer from the pattern layer 82 for transfer. Possible releasing agents are, for example, waxes, such as polyethylene waxes, amide waxes, Teflon powder, silicone waxes, carnauba wax, acrylic waxes and paraffin waxes, fluororesins, melamine resins, polyolefin resins, ionizing-radiation-setting polyfunctional acrylate resins, polyester resins, epoxy resins, and amino-modified, epoxy-modified, OH-modified, COOH-modified, catalytic curing, photocurable, thermosetting silicone oils or silicone resins. The thickness of the releasing layer may be in the range of 10 to 300 $\mu$m.

The paste layer 83 is formed on the pattern layer 82 laminated to the base film 81. If the paste layer 83 is used for forming partition walls, a material for forming the paste layer 83 is prepared by mixing inorganic components including glass frit, and a resin to be removed later by burning.

Suitable glass frits have a softening point in the range of 350 to 650° C. and a coefficient of thermal expansion $\alpha_{300}$ in the range of $60\times10^{-7}$ to $100\times10^{-7}$/° C. A glass frit having a softening point exceeding 650° C. needs high burning temperature which may cause the thermal deformation of a member to which the paste layer 83 is to be laminated by burning. A glass frit having a softening point below 350° C. may possibly melt before the resin is decomposed and volatilized and voids may be formed in the layer formed by burning the transferred paste layer 83. Strain may be induced in layers formed of the paste layer 83 of a material containing a glass frit having a coefficient of thermal expansion outside the range of $60\times10^{-7}$/° C. to $100\times10^{-7}$/° C. because the difference between the coefficient of thermal expansion of the glass frit and that of the glass plate is excessively large.

The inorganic components other than the glass frit may be a mixture of an inorganic powder or powders, and an inorganic pigment or pigments.

The material for forming the paste layer 83 may contain an inorganic powder, i.e., a filler, if necessary. The inorganic powder prevents the flow of the layers of the material during burning and enhancing the compactness of the layers. The inorganic powder is a powder of a substance having a softening point higher than that of the glass frit, such as aluminum oxide, strontium oxide, barium oxide, calcium carbonate or the like, and has a mean particle size in the range of 0.1 to 20 $\mu$m. The inorganic powder content is in the range of 0 to 30 parts by weight for a glass frit content of 100 parts by weight.

The inorganic pigment is used, if necessary, to improve practical contrast by reducing the reflection of external light. For dark coloring, a fire-resistant black pigment, such as Co—Cr—Fe, Co—Mn—Fe, Co—Fe—Mn—Al, Co—Ni—Cr—Fe, Co—Ni—Mn—Cr—Fe, Co—Ni—Al—Cr—Fe or Co—Mn—Al—Cr—Cr—Fe—Si, is used. Suitable fire-resistant white pigments are titanium oxide, aluminum oxide, silica calcium carbonate and such.

The resin which is removed by burning is a thermoplastic resin or a curable resin. The resin serves as a binder or a material for improving the transferability of the paste.

Preferable thermoplastic resins are, for example, polymers or copolymers of one or some of methyl acrylate, methyl methacrylate, ethyl acrylate, ethyl methacrylate, n-propyl acrylate, n-propyl methacrylate, isopropyl acrylate, isopropyl methacrylate, sec-butyl acrylate, sec-butyl methacrylate, isobutyl acrylate, isobutyl methacrylate, tert-butyl acrylate, tert-butyl methacrylate, hydroxyethyl acrylate, hydroxyethyl methacrylate, hydroxypropyl acrylate and hydroxypropyl methacrylate, ethylcellulose and polybuten derivatives.

Suitable curable resins are those mentioned above in connection with the description of the material for forming the pattern layer 82 laminated to the base film 81.

A preferable resin content of the paste layer 83 is in the range of 3 to 50 parts by weight, more preferably, 5 to 30 parts by weight for the inorganic component content of 100 parts by weight. If the resin content is less than 3 parts by weight, pattern retaining ability of the paste layer 83 is unsatisfactory, which cause problems in fabricating PDPs or the like. If the resin content is greater than 50 parts by weight, carbon remains in the burnt paste layer 83, which deteriorate the quality.

If necessary, the paste may contain a plasticizer, a thickener, a dispersant, a sedimentation inhibitor, a defoaming agent, a releasing agent and/or a leveling agent.

The plasticizer improves the transferability and the fluidity of the paste. Suitable plasticizers are, for example, phthalate esters, such as dimethyl phthalate and dibutyl phthalate, trimellitate esters, such as tri-2-ethylhexyl trimellitate and tri-n-alkyl trimellitate, dibasic aliphatic acid esters, such as dimethyl adipate and dibutyl adipate, and glycol derivatives.

The thickener is added to the paste to increase the viscosity of the paste when necessary. Suitable thickeners are, for example, hydroxyethylcellulose, methylcellulose and carboxymethylcellulose.

The dispersant and the sedimentation inhibitor are used for improving the dispersion of the inorganic components and to prevent the sedimentation of the same. Possible dispersants and sedimentation inhibitors are, for example, phosphates, silicones, castor oil esters and surface-active agents. Possible defoaming agents are, for example, silicon defoaming agents, acrylic defoaming agents and surface-active agents. Possible releasing agents are, for example, silicones, fluorine compounds, paraffins, fatty acids, fatty acid esters, castor oil, waxes and compounds. Possible leveling agents are, for example, fluorine compounds, silicones and surface-active agents. Those additives are used in appropriate contents.

When used, the paste is dissolved in or decomposed by methanol, ethanol, isopropanol, aceton, methyl ethyl ketone, toluene, xylene, an anone, such as cyclohexanone, methylene chloride, 3-methoxybutyl acetate, ethylene glycol monoalkylethers, ethylene glycol alkylether acetates, diethylene glycol monoalkylethers, diethylene glycol monoalkylether acetates, propylene glycol monoalkylether acetates, dipropylene glycol monoalkylethers, dipropylene glycol monoalkylether acetates, and terpenes including $\alpha$- or $\beta$-terpineol. The paste may be of a nonsolution type not dissolved in any one of those solvents.

When necessary, the working surface of the transfer printing sheet formed by laminating the pattern layer 82 to the base film 81 is coated with a protective film to protect the working surface from damaging actions and to prevent blocking and contamination. Suitable protective films are those of polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohols, cellophane, cellulose derivatives, such as cellulose acetate, polyethylenes, polyvinyl chlorides, nylons, polyimides and ionomers. The protective film has a surface treated with silicone, melamine acrylate or wax for lubrication and a thickness in the range of 1 to 400 $\mu$m preferably, 4.5 to 200 $\mu$m.

The transfer printing sheet may be wound in a roll after forming the paste layer 83 by filling up recesses defined by the pattern layer 82 on the base film 81 and, if necessary, coating the surface of the pattern layer 82 with the protective film. However, the surface of the pattern layer 82 need not necessarily be coated with a protective film before transferring the paste layer 83 to the base member 84. The base film 81 may be cut in a desired length, and then the paste layer 83 may be formed by filling up the recesses defined by the pattern layer. The base film 81 may be cut in a desired length after forming the paste layer 83.

A paste pattern forming method using the transfer printing sheet formed by laminating the pattern layer 82 to the base film 81 and forming the paste layer 83 on the pattern layer 82 will be described with reference to FIGS. 8 and 9.

The transfer printing sheet carrying the pate layer 83 is superposed on the base member 84, and then a pressure is applied to the transfer printing sheet by pressing the transfer printing sheet with a pressure roller, not shown, from the back of the base film 81 to transfer the paste layer 83 to the base member 84. If the paste forming the paste layer 83 contains a thermoplastic resin, it is desirable to apply pressure and heat to the transfer printing sheet by hot-pressing using a hot roller or laser beams. If the paste forming the paste layer 83 contains a curable resin, it is desirable to harden the plate layer 83 by irradiating the paste layer 83 with radiations or by applying heat to the paste layer 83 after superposing the transfer printing sheet on the base member 84 or the paste layer 83 may be hardened after the same has been transferred to the base member 84. The transfer printing sheet may be pressed against the base member 84 with a hot roller when the same is being superposed on the base member 84.

If the paste pattern is a pattern of the partition walls of a PDP, the base member 84 is a glass plate 3 provided with only an electrode layer, or an electrode layer and a dielectric layer on the inner surface thereof or on a base layer formed on the inner surface thereof.

A plurality of paste layers 83 respectively containing different pigments may be formed in the recesses defined by the pattern layer 82 on the base film 81. For example, the paste layer 83 may be of a two-layer paste layer formed by depositing a black paste layer and a white paste layer in that order in the recesses defined by the pattern layers 82. When the two-layer paste layer is transferred to the base member 84, the partition walls 1*a*, 1*b* and 1*c* consisting of a white base layer and a black top layer formed on top of the while base layer can be formed. The black front surfaces of the partition walls 1*a*, 1*b* and 1*c* enhances contrast.

When forming a pattern of a desired thickness on the base member 84, operations for filling up the recesses defined by the pattern layer 82 with the paste and transferring the paste layer to the base member 84 may be repeated a plurality of times.

The paste pattern forming method using the transfer printing sheet is particularly suitable for forming a fine pattern, such as a pattern of the partition walls 1*a*, 1*b* and 1*c*, and is capable of curtailing time necessary for fabricating the pattern, of increasing the yield and of accurately forming a pattern of a uniform thickness. The pattern of the paste layer 83 formed on the base member 84 is burned at temperatures in the range of 350 to 650° C. to gasify, decompose and volatilize the organic components of the paste layer 83 so that the inorganic powder is bonded in a high density by the molten glass frit to form an electrode layer, a base layer or a dielectric layer as well as the partition walls.

The method of forming the partition walls 1*a*, 1*b* and 1*c* and the auxiliary partition walls 52*a* to 52*d* is not limited to the foregoing paste pattern forming method. For example, lower portions of the partition walls 1*a*, 1*b* and 1*c* may be formed in the height of the auxiliary partition walls 52*a* to 52*d* together with the auxiliary partition walls 52*a* to 52*d* by a first process, and then upper portions of the partition walls 1*a*, 1*b* and 1*c* may be formed by a second process to complete the partition walls 1*a*, 1*b* and 1*c*. When the partition walls 1*a*, 1*b* and 1*c* and the auxiliary partition walls 52*a* to 52*d* are thus formed by the first and the second process, a photolithographic process using photosensitive materials, a printing process, a sand blasting process and a molding process which forms a mold on a base plate and fills the mold with a paste can be applied to forming the partition walls 1*a*, 1*b* and 1*c* and the auxiliary partition walls 52*a* to 52*d* of the present invention.

EXAMPLES

Concrete examples of the PDP in the second embodiment will be described hereinafter.

Formation of Base Film

In FIG. 10, A UV ray curing ink (DKF-901 available from Nippon Kayaku K.K.) was loaded on an ink feeder. A 754 μm thick polyethylene terephthalate film was used as the base film 81. UV light sources (600 mJ/cm$^2$) were used as the radiation sources S1 and S2. The gravure printing cylinder 33 was rotated at a surface velocity of 5 m/min to form pattern layers 82 having recesses on the base film 81 as shown in FIG. 10. The patterns of the pattern layers 82 are complementary to that of the partition walls 1*a* to 1*c* and the auxiliary partition walls 52*a* to 52*d* shown in FIG. 4, and that of the partition walls 1*a* to 1*c* and the auxiliary partition walls 54*a* to 54*d* shown in FIG. 5, respectively. The recesses of the pattern layer 82 for forming the partition walls 1*a* to 1*c* were 70 μm in width and 180 μm in depth, those for forming the auxiliary partition walls 52*a* to 52*d* were 50 μm in width and 100 μm in depth, and those for forming the auxiliary partition walls 54*a* to 54*d* were 30 μm in the width of the bottom, 60 μm in the width of the open end and 100 μm in depth.

Composition of the Partition Wall Forming Paste

Glass frit: MB-008, Matunami Garasu Kogyo K.K., 65 parts by weight

α-Alumina: RA-40, Iwatani Kagaku Kogyo, 10 parts by weight

Daipirokizaido black #9510, Dainichi Seika Kogyo K.K., 10 parts by weight n-Butyl methacrylate/2-hydroxyethyl methacrylate copolymer (8/2), 8 parts by weight Polyoxyethylene trimethylolpropane triacrylate, 8 parts by weight Silicone resin: X-24-8300, Shinetsu Kagaku Kogyo K.K. 1 part by weight Photopolymerization initiator: Ilgacure 369, Ciba Geigy, 3 parts by weight Propylene glycol monomethyl ether, 10 parts by weight Isopropyl alcohol, 10 parts by weight A partition wall forming paste was prepared by mixing these component materials by a bead mill using ceramic beads.

Transfer Printing Sheet

The partition wall forming paste was filled in the recesses of the pattern layer 82 by means of a doctor, and a polyethylene film was laminated to the pattern layer 82 to form a transfer printing sheet (81, 82, 83) in accordance with the present invention.

Formation of Partition Walls

The polyethylene film was removed from the transfer printing sheet, and then the transfer printing sheet was laminated to a back glass plate 3 heated at a preheating temperature of 80° C. and provided with a base layer, electrodes and a dielectric layer formed on its inner surface in that order by an autocut laminator (ACL-9100, Asahi Kasei K.K.) using a laminating roller heated at 100° C.

Then, the base film 81 and the pattern layer 82 were removed from the back glass plate 3 and a pattern of the partition wall forming paste transferred from the transfer printing sheet to the back glass plate 3 was burnt at 570° C. to form partition walls 1*a*, 1*b* and 1*c*.

A PDP employing the back glass plate 3 provided with the thus formed partition walls 1*a*, 1*b* and 1*c*, and auxiliary partition walls 52*a* to 52*d*, and a PDP employing the back glass plate 3 provided with the thus formed partition walls 1*a*, 1*b* and 1*c*, and auxiliary partition walls 54*a* to 54*d* were fabricated, and the characteristics of the PDPs were measured. Measured results are tabulated in Table 1.

The measured results proved that the auxiliary partition walls 52*a* to 52*d*, and 54a to 54*d* enhanced the luminance of the phosphor surfaces of the PDPs.

TABLE 1

| Shape of partition walls | Dimensions of partition walls after burning (μm) | Relative luminance (%) |
|---|---|---|
| FIG. 4 | partition walls: 50 W × 120 H<br>Aux. partition walls: 35 W × 65 H | 140 |
| FIG. 5 | partition walls: 50 W × 120 H<br>Aux. partition walls: 20 to 40 W × 65 H | 145 |
| without auxiliary partition wall | Partition walls: 50 W × 120 H | 100 |

The present invention, which forms the partition walls in parallel to the address electrodes on the inner surface of the back glass plate, and the auxiliary walls in parallel to the bus electrodes on the inner surface of the back glass plate so that the discharge spaces respectively corresponding to the spatial intersections of the address electrodes and the bus electrodes are isolated from each other, enhances the luminance of the surface and prevents the leakage of a discharge and UV rays generated by a discharge in the discharge space into the adjacent discharge spaces.

When the auxiliary partition walls are formed in a cross section, i.e., a section in a plane parallel to the address electrodes, diverging toward the back glass plate, the apparent luminance of the surfaces is further enhanced, and the auxiliary partition walls have a large area on the back glass plate, which enhances the strength of the structure of the partition walls and the auxiliary partition walls. Consequently, the volume of the discharge spaces is increased and discharge efficiency is improved. Since pixels can be formed at small pitches, a high-definition PDP can be constructed.

When the auxiliary partition walls are formed in a height in the range of ½ to ⅚ of that of the partition walls, the foregoing effects can be exercised and the phosphor surfaces can be easily formed.

Third Embodiment

Figure 11:
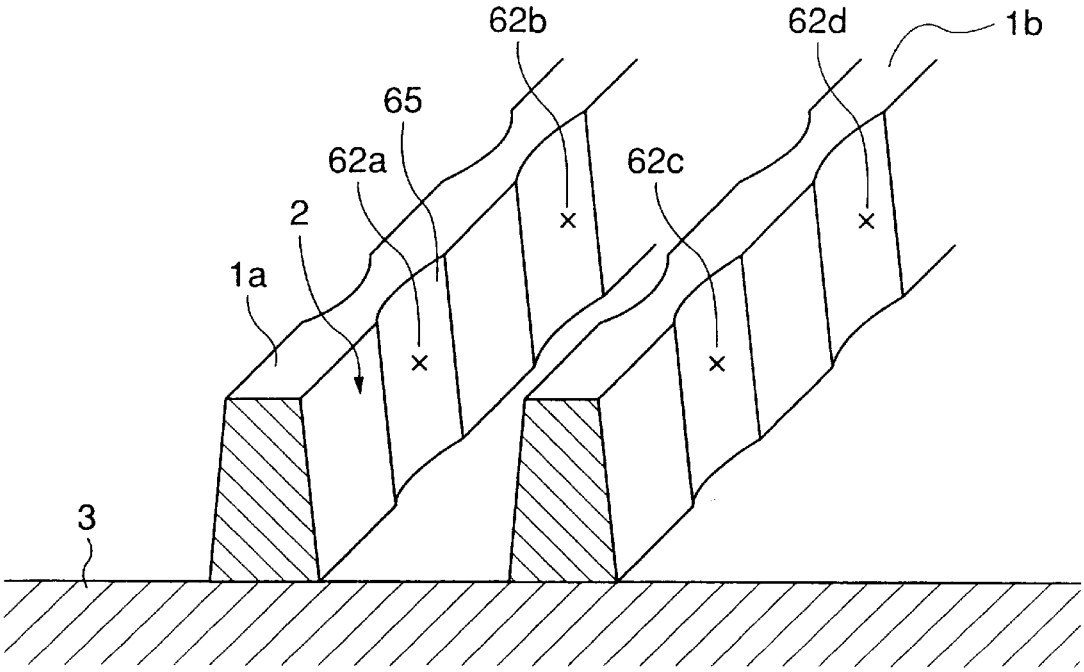
FIG. 11 is an enlarged fragmentary typical view of partition walls included in a plasma display panel in a third embodiment according to the present invention.
Figure 12:
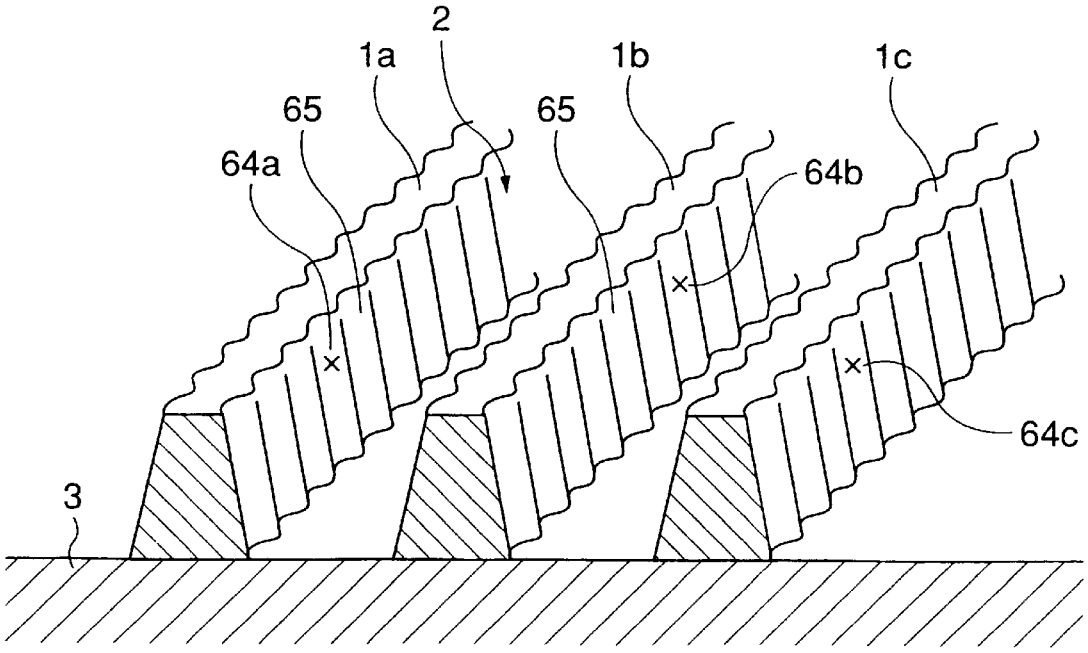
FIG. 12 is an enlarged fragmentary typical perspective view of partition walls in another modification of the partition walls of FIG. 11.
Figure 13:
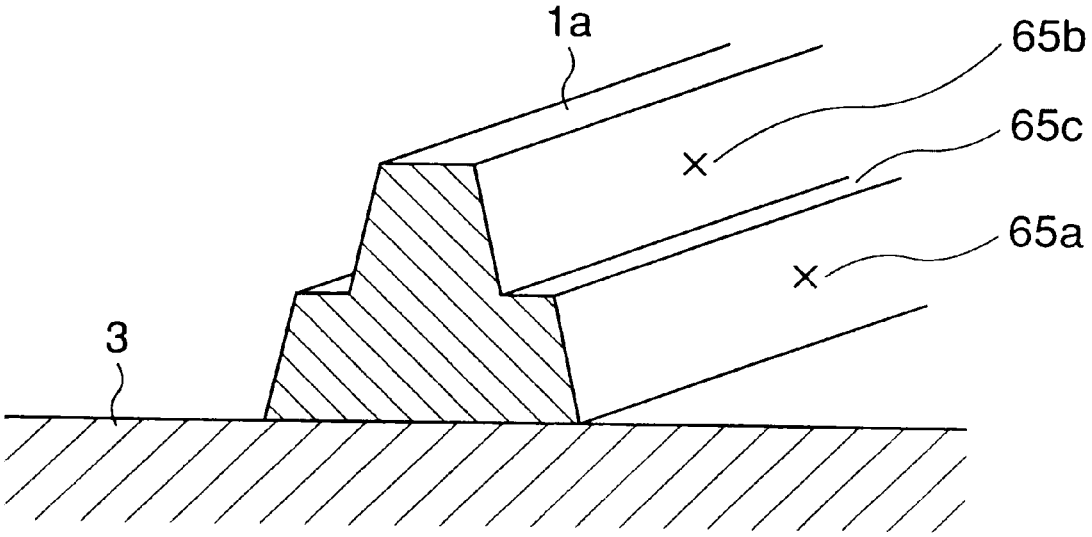
FIG. 13 is an enlarged fragmentary typical perspective view of partition walls in a modification of the partition walls of FIG. 11.

A PDP (plasma display panel) in a third embodiment according to the present invention will be described with reference to FIGS. 11 to 13, in which parts like or corresponding to those of the first and the second embodiment illustrated in FIGS. 1 to 10 are designated by the same reference characters and the description thereof will be omitted. FIGS. 11 to 13 illustrate possible shapes of partition walls of the PDP in the third embodiment. In FIG. 11 to 13, indicated at 1*a*, 1*b* and 1*c* are partition walls (barrier ribs), at 62*a*, 62*b*, 62*c*, and 62*d* are narrow sections having a reduced width in the partition walls 1*a*, 1*b* and 1*c*, at 3 is a back glass plate, at 64*a*, 64*b* and 64*c* are corrugated side surfaces of the partition walls 1*a*, 1*b* and 1*c*, and at 65*a* and 65*b* are a base portion and a top portion, respectively, of the stepped partition walls 1*a*, 1*b* and 1*c* shown in FIG. 13 having steps 65*c* where the width changes discontinuously.

Actually, the back glass plate 3 has many partition walls other than the partition walls 1*a*, 1*b* and 1*c*, only the partition walls 1*a* and 1*b* are shown in FIG. 11, only the partition walls 1*a*, 1*b* and 1*c* are shown in FIG. 12, and only the partition wall 1*a* is shown in FIG. 13.

Referring to FIGS. 11, 12 and 13, the partition walls 1*a*, 1*b* and 1*c* are formed in parallel to address electrodes 8 (FIG. 1) on a back glass plate 3. The address electrodes 8 are formed on the bottoms of grooves between the partition walls 1*a*, 1*b* and 1*c* on the back glass plate 3. The partition walls 1*a*, 1*b* and 1*c* shown in FIGS. 11 and 12 have a trapezoidal cross section, i.e., a section in a plane perpendicular to the partition walls 1*a*, 1*b* and 1*e*, and the partition wall 1*a* shown in FIG. 13 has a stepped trapezoidal cross section resembling a combination of two different trapezoids. The partition walls 1*a*, 1*b* and 1*c* may be formed in a shape other than those shown in FIGS. 11, 12 and 13. For example, the partition walls 1*a*, 1*b* and 1*c* may have a rectangular cross section or a cross section defined by curved lines.

Referring to FIG. 11, the partition walls 1*a* and 1*b* have narrow sections 62*a*, 62*b*, 62*c*, and 62*d* corresponding to discharge cells 65 in the discharge space 2 and having a reduced width. The narrow sections 62*a* and 62*c* are formed opposite to each other to define the discharge cell 65 in the discharge space 2, and the narrow sections 62*b* and 62*d* are formed opposite to each other to define the discharge cell 65 in the discharge space 2. The discharge cells 65 correspond to the spatial intersections of the address electrodes 8 and bus electrodes 5 (FIG. 1), respectively.

Those partition walls 1*a*, 1*b* and 1*c* of the foregoing shape enables the formation of the discharge cells 65 in a relatively large volume in the discharge spaces 2, so that UV rays can be efficiently generated. Since phosphor layers 9 (FIG. 1) can be formed in a relatively large light emitting area and UV rays acts efficiently on the phosphor layers 9, the luminance of the phosphor layers 9 can be enhanced. Since sections of the partition walls 1*a*, 1*b* and 1*c* other than the narrow sections 62*a* to 62*d* have a width great enough to bond the partition walls 1*a*, 1*b* and 1*c* firmly to the back glass plate 3 and to be in close contact with a front glass plate 10 to isolate the address electrodes 8 from each other.

The partition walls 1*a*, 1*b* and 1*c* shown in FIG. 12 have corrugated side surfaces 64*a*, 64*b* and 64*c* having an area greater than flat side surfaces of dimensions equal to those of the corrugated side surfaces 64*a*, 64*b* and 64*c*. Therefore, the area of the side surfaces of the discharge cells 65 is increased, the light emitting area of the phosphor surface in increased, UV rays act efficiently and thereby the luminance of the phosphor surfaces is enhanced.

The stepped partition wall 1*a* shown in FIG. 13 is formed in the shape of a combination of the base portion 65*a* and the top portion 65*b* having the shapes of trapezoidal prisms of different sizes, and the steps 65*c* are formed between the base portion 65*a* and the top portion 65*b*. The section of the partition wall la expands (diverges) toward the back glass plate 3. The partition wall 1*a* having the foregoing shape increases the light emitting area of the phosphor surface, and the luminance of the phosphor surface is enhanced because UV rays are able to act efficiently.

A representative partition wall forming method for forming the partition walls of the PDP in accordance with the present invention will be described hereinafter with reference to FIGS. 6 to 9.

FIG. 6 is a typical sectional view of a base film 81 provided with a pattern layer 82 having recesses, FIG. 7 is a typical sectional view of a transfer printing sheet consisting of the base film 81, the pattern layer 92 and a paste layer 83 for forming the partition walls, and FIGS. 8 and 9 are typical sectional views of assistance in explaining the partition wall forming method employing the transfer printing sheet (81, 82, 83) shown in FIG. 7.

Although the partition wall forming method is applicable not only to forming partition walls but also to forming base layers, electrodes and dielectric layers in a desired pattern, the patterned layer forming method will be described as applied to forming partition walls herein. Shown in FIGS. 6 to 9 are a base film 81, a pattern layer 82 provided with recesses arranged in a predetermined pattern, a paste layer 83, and a base member 84 to which the paste layer 83 is to be transferred by transfer printing to form partition walls.

The base film 81 is a film which will not be affected by the solvent contained in the paste layer 83 and will neither contract nor elongate when exposed to heat during operation. The base film 81 is a sheet or a film of a plastic material, such as polyethylene terephthalate, or a foil of a metal, such as aluminum or copper. The thickness of the base film 81 is, for example, in the range of 100 to 300 μm.

The pattern layer 82 formed on the base sheet 81 is provided with recesses formed in a pattern of partition walls to be formed by using the transfer printing sheet; that is the shape of the recesses is complementary to that of partition walls to be formed as shown and described above. The recesses may be formed in a surface of the base film 81 by embossing or etching, or the base film 81 may be such as formed by molding and provided with the recesses formed by molding. Preferably, the recesses are formed by printing a curable resin in a pattern having recesses of a pattern equal to that of the recesses of the pattern layer 82 to be formed on the base film 81 with a gravure printing cylinder.

The partition walls 1*a*, 1*b* may be formed by a method other than the foregoing method. For example, the partition walls in accordance with the present invention may be formed by a method employing a photolithographic process using photosensitive materials, a printing process, a sand blasting process or a molding process which forms a mold on a base plate and fills the mold with a paste. When forming the partition wall la as shown in FIG. 13, the base portion 65*a* of the partition wall 1*a* may be formed in a predetermined height by a first process, and then the top portion 65*b* of the partition wall 1*a* may be formed by a second process to complete the partition wall 1*a* of a predetermined height.

EXAMPLES

Examples of the PDP in the third embodiment will be described hereinafter.

Formation of Base Film

A UV ray curing ink (DKF-901 available from Nippon Kayaku K.K.) was loaded on the ink feeder of the apparatus shown in FIG. 10. A 754 μm thick polyethylene terephthalate film was used as the base film 81. UV light sources (600 mJ/cm$^2$) were used as the radiation sources S1 and S2. The gravure printing cylinder 33 was rotated at a surface velocity of 5 m/min to form pattern layers 82 having recesses on the base film 81 as shown in FIG. 10. The patterns of the pattern layers 82 are complementary to those of the partition walls shown in FIGS. 11, 12 and 13, respectively. The recesses of the pattern layer 82 for forming the partition walls 1*a* and 1*b* of FIG. 11 have sections of 70 μm in width corresponding to wide sections of the partition walls 1*a* and 1*b*, and sections of 30 (m corresponding to the narrow sections 62*a* to 62*d*, and have a depth of 180 μm. The recesses of the pattern layer 82 for forming the partition walls 1*a*, 1*b* and 1*c* of FIG. 12 have sections of 70 μm in width and sections of 40 μm in width and has a depth of 180 μm. The recesses of the pattern layer 82 for forming the partition wall 1*a* of FIG. 13 have each a portion of 70 μm in width and 180 μm in depth corresponding to the top portion 65*b*, and a portion of 120 μm in width and 90 (m in depth corresponding to the base portion 65*a*. The recesses for forming conventional partition walls having a rectangular cross section are 70 μm in width and 180 μm in depth.

Composition of the Partition Wall Forming Paste

Glass frit: MB-008, Matunami Garasu Kogyo K.K., 65 parts by weight

α-Alumina: RA-40, Iwatani Kagaku Kogyo, 10 parts by weight

Daipirokizaido black #9510, Dainichi Seika Kogyo K.K., 10 parts by weight n-Butyl methacrylate/2-hydroxyethyl methacrylate copolymer (8/2), 8 parts by weight Polyoxyethylene trimethylolpropane triacrylate, 8 parts by weight Silicone resin: X-24-8300, Shinetsu Kagaku Kogyo K.K., 1 part by weight Photopolymerization initiator: Ilgacure 369, Ciba Geigy, 3 parts by weight Propylene glycol monomethyl ether, 10 parts by weight Isopropyl alcohol, 10 parts by weight A partition wall forming paste was prepared by mixing these component materials by a bead mill using ceramic beads.

Transfer Printing Sheet

The partition wall forming paste was filled in the recesses of the pattern layer 82 by means of a doctor, and a polyethylene film was laminated to the pattern layer 82 to form a transfer printing sheet (81, 82, 83) in accordance with the present invention.

Formation of Partition Walls

The polyethylene film was removed from the transfer printing sheet, and then the transfer printing sheet was laminated to a back glass plate 3 heated at a preheating temperature of 80° C. and provided with a base layer, electrodes and a dielectric layer formed on its inner surface in that order by an autocut laminator (ACL-9100, Asahi Kasei K.K.) using a laminating roller heated at 100° C.

Then, the base film 81 and the pattern layer 82 were removed from the back glass plate 3 and a pattern of the partition wall forming paste transferred from the transfer printing sheet to the back glass plate 3 was burnt at 570° C. to form partition walls.

PDPs employing the back glass plates 3 provided with the thus formed partition walls were fabricated, and the characteristics of the PDPs were measured. Measured results are tabulated in Table 2.

TABLE 2

| Shape of partition walls | Dimensions of partition walls after burning (μm) | Relative luminance (%) |
|---|---|---|
| FIG. 11 | 50 Max. W × 120 H, 20 Min. W × 120 H | 120 |
| FIG. 12 | 50 Max. W × 120 H, 20 Min. W × 120 H | 125 |
| FIG. 13 | 50 W × 120 H (5b), 80 W × 60 H (5a) | 120 |
| Rectangular wall | 50 W × 120 H | 100 |

The measured results proved that the partition walls of the PDPs in accordance with the present invention enhanced the luminance of the phosphor surfaces of the PDPs.

Fourth Embodiment

A PDP (plasma display panel) in a fourth embodiment according to the present invention will be described hereinafter with reference to FIGS. 14 to 16, in which parts like or corresponding to those of the first embodiment shown in FIGS. 1 to 3, the second embodiment shown in FIGS. 4 to 10 and the third embodiment shown in FIGS. 11 to 13 are designated by the same reference characters and the description thereof will be omitted. The PDP in the fourth embodiment is characterized by gaps formed between the partition walls (only two partition wall (barrier ribs) 1*a* and 1*b* are shown in FIGS. 14 and 15) and the front glass plate.

Figure 14:
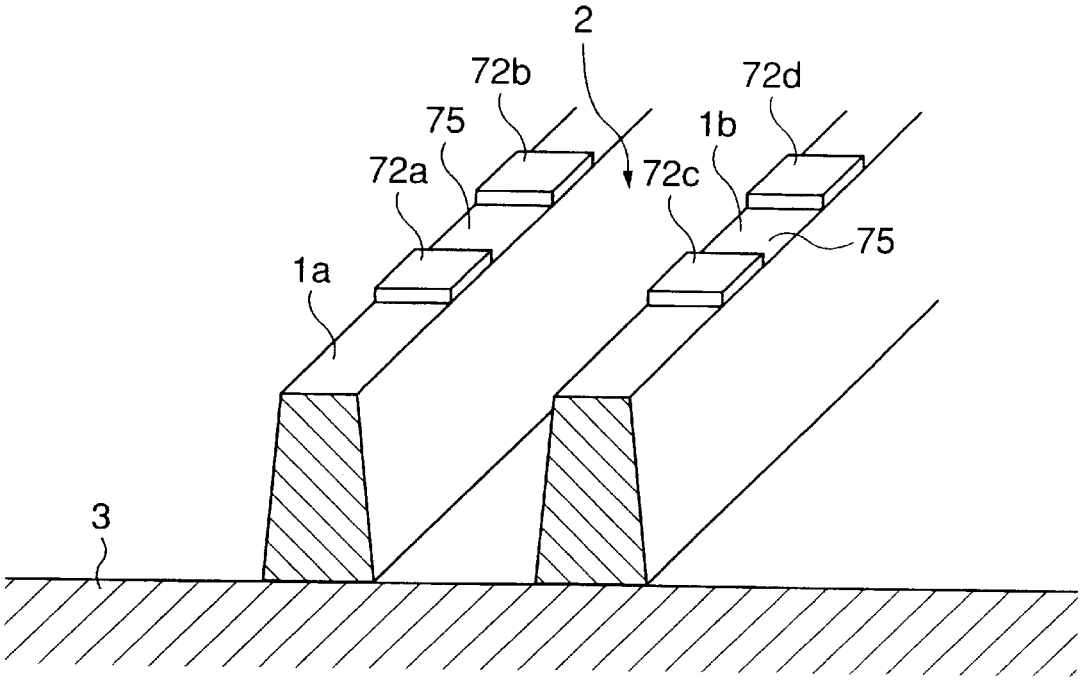
FIG. 14 is an enlarged fragmentary typical perspective view of partition walls included in a plasma display panel in a fourth embodiment according to the present invention.
Figure 15:
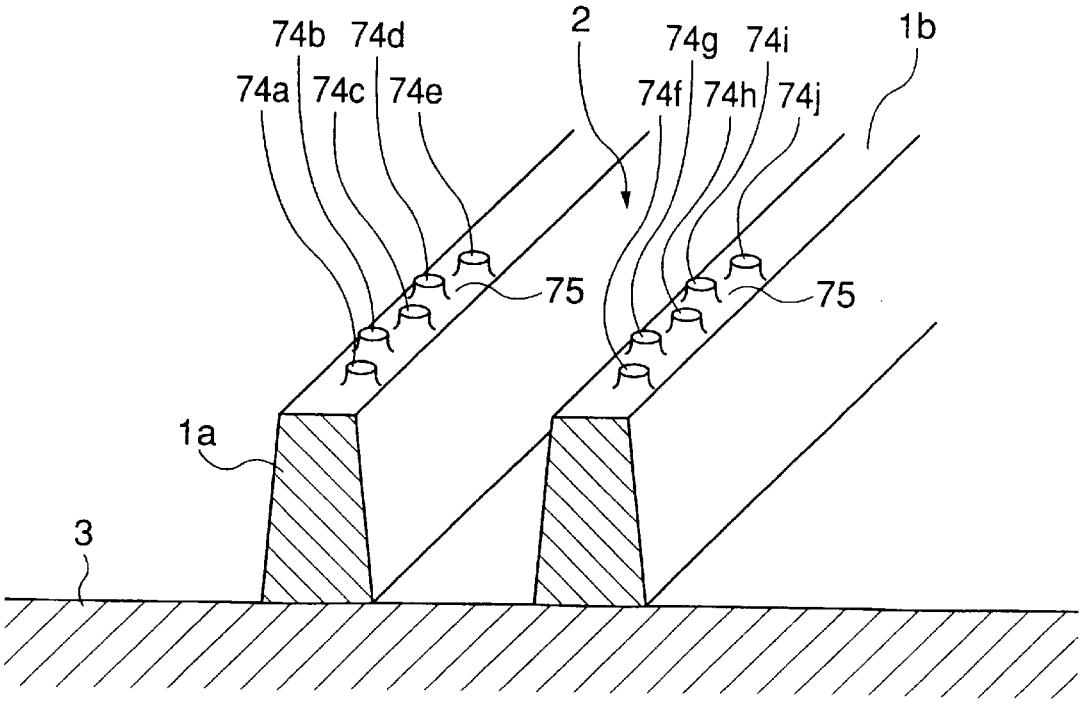
FIG. 15 is an enlarged fragmentary typical view of partition walls in a modification of the partition walls of FIG. 14.

Shown in FIGS. 14 and 15 are the partition walls 1*a* and 1*b*, protrusions 72*a*, 72*b*, 72*c* and 72*d* among those formed on the top surfaces of the partition walls 1*a* and 1*b* shown in FIG. 14, protrusions 74*a*, 74*b*, 74*c*, 74*d*, 74*e*, 74*f*, 74*g*, 74*h*, 74*i* and 74*j* among those formed on the top surfaces of the partition walls 1*a* and 1*b* shown in FIG. 15, and back glass plates 3.

The address electrodes 8 (FIG. 1) are formed in portions of the inner surface of the back glass plate 3 between the adjacent partition walls. The partition walls 1*a* and 1*b* are formed in parallel to the address electrodes 8. The partition walls 1*a* and 1*b* have a cross section, i.e., a section in a plane perpendicular to a direction in which the partition walls 1*a* and 1*b* extend, of a trapezoidal shape. The partition walls 1*a* and 1*b* may have a cross section of a rectangular shape or a cross section defined by curved lines.

The protrusions 72*a* to 72*d* formed on the top surfaces of the partition walls 1*a* and 1*b* of FIG. 14 have the shape of a rectangular plate, and the front glass plate 10 (FIG. 1) is put in close contact with the protrusions 72*a* to 72*d*, so that spaces 75 are formed between portions of the top surfaces of the partition walls 1*a* and 1*b* not provided with any protrusions and the inner surface of the front glass plate 10. Therefore, the adjacent discharge spaces 2 respectively provided with the address electrodes 8 are able to communicate with each other by means of the gaps 75. Similarly, the protrusions 74*a* to 74*j* formed on the top surfaces of the partition walls 1*a* and 1*b* of FIG. 15 have the shape of a circular plate, and the front glass plate 10 (FIG. 1) is put in close contact with the protrusions 74*a* to 74*j*, so that spaces 75 are formed between portions of the top surfaces of the partition walls 1*a* and 1*b* not provided with any protrusions and the inner surface of the front glass plate 10. Therefore, the adjacent discharge spaces 2 respectively provided with the address electrodes 8 are able to communicate with each other by means of the gaps 75.

The protrusions 72*a* to 72*d* and 74*a* to 74*j* enhance discharge efficiency, which will be described later, whereby the luminance of the phosphor layers can be increased.

Figure 16:
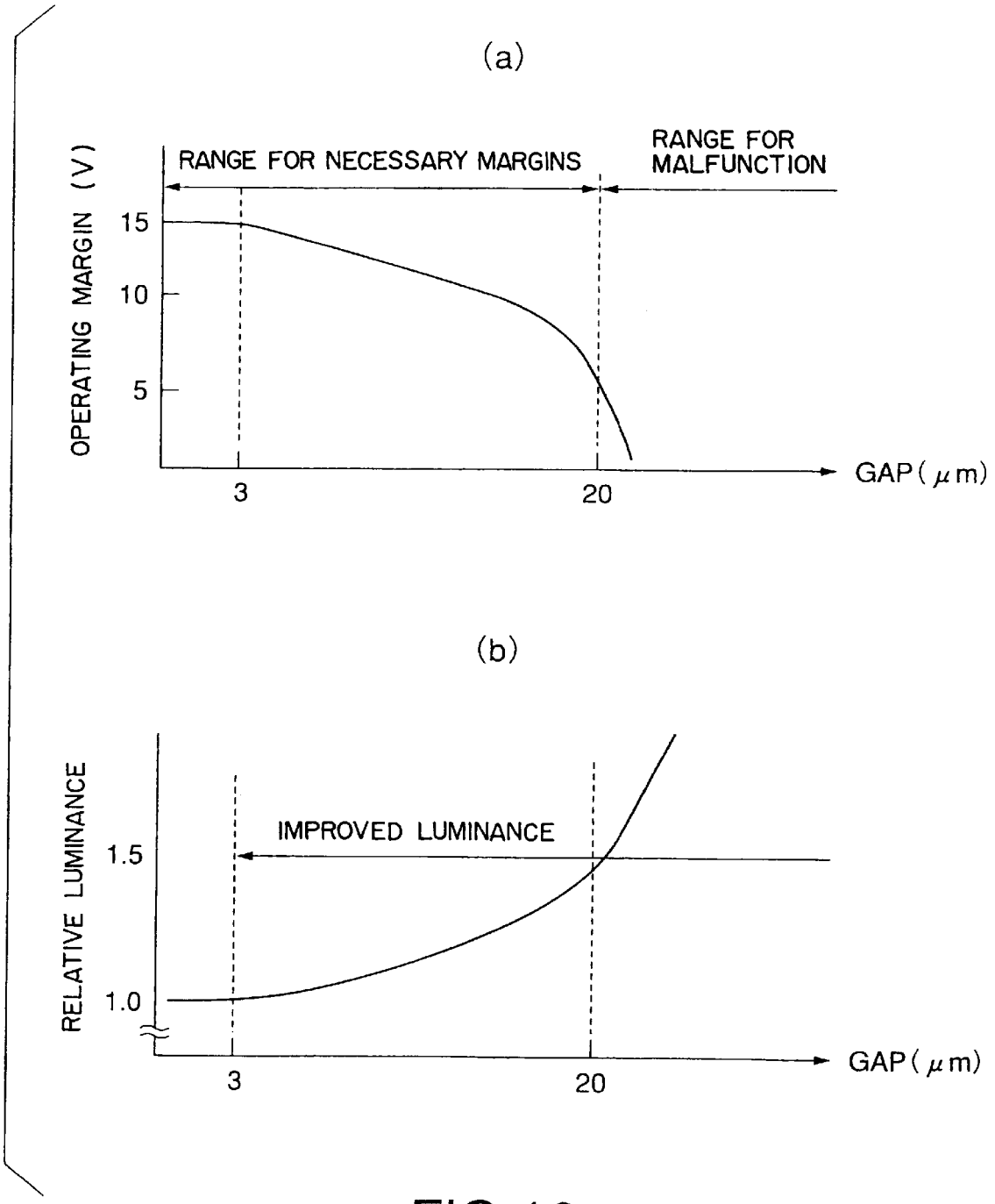
FIG. 16 is graphs showing the relation between the gap (GAP) between a partition wall and a front plate, and a discharge starting voltage (Vm).

FIG. 16(*a*) is a graph showing the relation between the height of the protrusions 72*a* to 72*d* and 74*a* to 74*j* equal to gap thickness (GAP), i.e., the thickness of the gaps 75, and operating margin (V), and FIG. 16(*b*) shows the relation between gap thickness (GAP) and relative luminance (B), i.e., the ratio of luminance for a gap thickness (GAP) to luminance for a gap thickness=0. As is obvious from FIG. 16(*a*), operating margin decreases as the gap thickness GAP increases. A sufficient margin is secured in a range where the gap thickness GAP is not greater than 20 μm. As is obvious from FIG. 16(*b*), the effect of the gaps 75 of 3 μm or below in gap thickness GAP on the enhancement of luminance is not significant.

Therefore, the protrusions 72*a* to 72*d* and 74*a* to 74*j* of the PDPs of the present invention are formed in a height in the range of 3 to 20 μm to secure a sufficient operating margin and to achieve the enhancement of luminance.

A partition wall forming method for forming the partition walls 1*a* and 1*b* provided with the protrusions 72*a* to 72*d* (74*a* to 74*j*) will be described with reference to FIGS. 6 to 9.

FIG. 6 is a typical sectional view of a base film 81 provided with a pattern layer having recesses, FIG. 7 is a typical sectional view of a transfer printing sheet consisting of the base film 81, the pattern layer 82 and a paste layer 83 for forming the partition layers, and FIGS. 8 and 9 are typical sectional views of assistance in explaining the partition wall forming method employing the transfer printing sheet (81, 82, 83) shown in FIG. 7.

Although the partition wall forming method is applicable not only to forming partition walls but also to forming base layers, electrodes and dielectric layers in a desired pattern, the patterned layer forming method will be described as applied to forming the partition walls 1*a* and 1*b* herein. Shown in FIGS. 6 to 9 are a base film 81, a pattern layer 82 having recesses arranged in a predetermined pattern, a paste layer 83, and a base member 84 to which the paste layer 83 is to be transferred by transfer printing to form the partition walls 1*a* and 1*b*.

The base film 81 is a film which will not be affected by the solvent contained in the paste layer 83 and will neither contract nor elongate when exposed to heat during operation. The base film 81 is a sheet or a film of a plastic material, such as polyethylene terephthalate, or a foil of a metal, such as aluminum or copper. The thickness of the base film 81 is, for example, in the range of 100 to 300 μm.

The pattern layer 82 formed on the base sheet 81 is provided with recesses formed in a pattern of partition walls to be formed by using the transfer printing sheet; that is the shape of the recesses is complementary to that of partition walls to be formed as shown and described above. The recesses may be formed in a surface of the base film 81 by embossing or etching, or the base film 81 may be such as formed by molding and provided with the recesses formed by molding. Preferably, the recesses are formed by printing a curable resin in a pattern having recesses of a pattern equal to that of the recesses of the pattern layer 82 to be formed on the base film 81 with a gravure printing cylinder.

The partition walls 1*a*, 1*b* provided with the protrusions 72*a* to 72*d* (74*a* to 74*j*) may be formed by a method other than the foregoing method. For example, the partition walls 1*a* and 1*b* provided with the protrusions 72*a* to 72*d* (74*a* to 74*j*) may be formed by a method which forms the partition walls 1*a* and 1*b* proper not having the protrusions 72*a* to 72*d* (74*a* to 74*j*) by a first process, and then forms the protrusions 72*a* to 72*d* (74*a* to 74*j*) on the top surfaces of the partition walls 1*a* and 1*b* by a second process. Such a method having the first and the second process may employ a photolithographic process using photosensitive materials, a printing process, a sand blasting process or a molding process which forms a mold on a base plate and fills the mold with a paste.

EXAMPLES

Examples of the PDP in the fourth embodiment will be described hereinafter.

Formation of Base Film

A UV ray curing ink (DKF-901 available from Nippon Kayaku K.K.) was loaded on the ink feeder of the apparatus shown in FIG. 10. A 754 μm thick polyethylene terephthalate film was used as the base film 81. UV light sources (600 mJ/cm$^2$) were used as the radiation sources S1 and S2. The gravure printing cylinder 33 was rotated at a surface velocity of 5 m/min to form pattern layers 82 having recesses for forming the partition walls shown in FIGS. 14 and 15, and conventional partition walls not provided with any protrusions on the base film 81 as shown in FIG. 10. The patterns of the pattern layers 82 are complementary to those of the partition walls shown in FIGS. 14 and 15, and the conventional partition walls, respectively. The recesses of the pattern layer 82 for forming the partition walls 1*a* and 1*b* are 70 μm in width and 170 μm in depth. The recesses of the pattern layer 82 for forming the protrusions 72*a*, to 72*d* are 70 μm in width, 70 m in length and 10 μm in depth. The recesses of the pattern layer 82 for forming the protrusions 74*a* to 74*j* are 20 μm in diameter and 10 μm in depth. The recesses of the pattern layer 82 for forming the partition walls not provided with any protrusions are 70 μm in width and 180 μm in depth.

Composition of the Partition Wall Forming Paste

Glass frit: MB-008, Matunami Garasu Kogyo K.K., 65 parts by weight

α-Alumina: RA-40, Iwatani Kagaku Kogyo, 10 parts by weight

Daipirokizaido black #9510, Dainichi Seika Kogyo K.K., 10 parts by weight n-Butyl methacrylate/2-hydroxyethyl methacrylate copolymer (8/2), 8 parts by weight Polyoxyethylene trimethylolpropane triacrylate, 8 parts by weight Silicone resin: X-24-8300, Shinetsu Kagaku Kogyo K.K., 1 part by weight Photopolymerization initiator: Ilgacure 369, Ciba Geigy, 3 parts by weight Propylene glycol monomethyl ether, 10 parts by weight Isopropyl alcohol, 10 parts by weight A partition wall forming paste was prepared by mixing these component materials by a bead mill using ceramic beads.

Transfer Printing Sheet

The partition wall forming paste was filled in the recesses of the pattern layer 82 by means of a doctor, and a polyethylene film was laminated to the pattern layer 82 to form a transfer printing sheet (81, 82, 83) in accordance with the present invention.

Formation of Partition Walls

The polyethylene film was removed from the transfer printing sheet, and then the transfer printing sheet was laminated to a back glass plate 3 heated at a preheating temperature of 80° C. and provided with a base layer, electrodes and a dielectric layer formed on its inner surface in that order by an autocut laminator (ACL-9100, Asahi Kasei K.K.) using a laminating roller heated at 100° C.

Then, the base film 81 and the pattern layer 82 were removed from the back glass plate 3 and a pattern of the partition wall forming paste transferred from the transfer printing sheet to the back glass plate 3 was burnt at 570° C. to form partition walls.

PDPs employing the back glass plates 3 provided with the thus formed partition walls were fabricated, and the characteristics of the PDPs were measured. Measured results are tabulated in Table 3.

TABLE 3

| Shape of partition walls | Dimensions of partition walls after burning (μm) | Relative luminance (%) |
|---|---|---|
| FIG. 14 | Partition walls: 50 W × 114 H<br>Protrusions: 50 W × 50 L × 6 H | 135 |
| FIG. 15 | Partition walls: 50 W × 114 H<br>Protrusions: 20 D × 6 H | 130 |
| Conventional | Partition walls: 50 W × 120 H | 100 |

The measured results proved that the partition walls of the PDPs in accordance with the present invention enhanced the luminance of the phosphor surfaces of the PDPs.

The gaps of a thickness in the range of 3 to 20 μm secure a sufficient operating margin.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein the phosphor layers are red phosphor layers containing a red phosphor substance, green phosphor layers containing a green phosphor substance, and blue phosphor layers containing a blue phosphor substance, and the partition walls contain at least one of a red pigment, a green pigment and a blue pigment.

2. The plasma display panel according to claim 1, wherein a black layer is provided on a top portion of each partition wall on the side of the front plate.

3. The plasma display panel according to claim 1, wherein the partition walls further contain a white pigment.

4. The plasma display panel according to claim 3, wherein the partition walls further contain glass frit, and the partition walls have a white pigment content in the range of 5 to 20 parts by weight with respect to a glass frit content of 100 parts by weight.

5. The plasma display panel according to claim 1, wherein the partition walls contain an appropriate amount of the red pigment, an appropriate amount of the green pigment and an appropriate amount of the blue pigment.

6. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein a plurality auxiliary partition walls are extended perpendicularly to the partition walls between the adjacent partition walls so as to divide the discharge spaces into separate discharge spaces.

7. The plasma display panel according to claim 6, wherein a plurality of bus electrodes are formed on the front plate, a plurality of address electrodes are formed on the back plate and perpendicular to the plurality of bus electrodes, and the separate discharge spaces correspond to spatial intersections formed by the bus electrodes and the address electrodes, respectively.

8. The plasma display panel according to claim 6, wherein the auxiliary partition walls have a cross section in a plane parallel to the partition walls diverging toward the back plate.

9. The plasma display panel according to claim 6, wherein the auxiliary partition walls have a height in the range of ½ to ⅚ of that of the partition walls.

10. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein the widths of corresponding portions of the adjacent partition walls are reduced relative to that of other portions of the same to form pairs of narrow sections in the adjacent partition walls.

11. The plasma display panel according to claim 10, wherein a plurality of bus electrodes are formed on the front plate, a plurality of address electrodes are formed on the back plate and perpendicular to the plurality of bus electrodes, and the pairs of narrow sections correspond to spatial intersections formed by the bus electrodes and the address electrodes, respectively.

12. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein the partition walls have corrugated side surfaces.

13. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein the partition walls have a cross section in a plane perpendicular thereto having a shape diverging toward a back plate; and wherein:

the partition walls have a width varying stepwise.

14. A plasma display panel comprising:

a front plate;

a back plate disposed in parallel and opposite to the front plate;

a plurality of parallel partition walls extended between the front and the back plate and defining discharge spaces between the adjacent partition walls; and phosphor layers respectively formed in the discharge spaces;

wherein gaps are formed between the partition walls and the front or the back plate.

15. The plasma display panel according to claim 14, wherein the gaps have a thickness in the range of 3 to 20 $\mu$m.

16. The plasma display panel according to claim 14, wherein the partition walls are provided with protrusions to form the gaps between the partition walls and the front or the back plate.

* * * * *